US011046506B2

(12) United States Patent
Breidenbach

(10) Patent No.: US 11,046,506 B2
(45) Date of Patent: Jun. 29, 2021

(54) PARTITIONED FOOD PACKAGE

(71) Applicant: Lindsay Bell Breidenbach, Maple Grove, MN (US)

(72) Inventor: Lindsay Bell Breidenbach, Maple Grove, MN (US)

( * ) Notice: Subject to any disclaimer, the term of this patent is extended or adjusted under 35 U.S.C. 154(b) by 865 days.

(21) Appl. No.: 13/964,090

(22) Filed: Aug. 11, 2013

(65) Prior Publication Data

US 2013/0320022 A1 Dec. 5, 2013

Related U.S. Application Data

(60) Provisional application No. 61/778,308, filed on Mar. 12, 2013.

(51) Int. Cl.

| | |
|---|---|
| ***B65D 85/78*** | (2006.01) |
| ***B65D 25/08*** | (2006.01) |
| ***B65D 25/04*** | (2006.01) |

(52) U.S. Cl.

CPC ..... *B65D 85/78* (2013.01); *B65D 25/04* (2013.01); *B65D 25/087* (2013.01); *Y10T 83/0467* (2015.04)

(58) Field of Classification Search

CPC ..... B65D 25/04; B65D 25/087; B65D 75/52; B65D 75/54; B65D 85/78

USPC ..... 206/804; 217/64; 221/71; 426/119, 426/124; 220/523

See application file for complete search history.

(56) References Cited

U.S. PATENT DOCUMENTS 554,592 A * 2/1896 Fuchs ..... B65D 83/0005 190/36
676,274 A * 6/1901 Porter ..... A45C 11/02 206/8

(Continued)

FOREIGN PATENT DOCUMENTS

EP 1 285 862 A1 2/2003
EP 1285862 A1 2/2003

(Continued)

OTHER PUBLICATIONS

OXO Good Grips Multi-Purpose Pastry Scraper/Chopper—JoshLoveslt.com—Jul. 8, 2012.

(Continued)

*Primary Examiner* — Ernesto A Grano
(74) *Attorney, Agent, or Firm* — Thomas S. Breidenbach

(57) ABSTRACT

A container for food includes an enclosure, a lid, and partition members. The enclosure includes an interior with a base portion and a perimeter portion. The perimeter portion includes one or more walls that extend between the base portion and an opening of the enclosure. The partition members separate food layers from each other. A base partition member separates a bottom food layer from the base portion of the interior. An opening partition member may separate the lid from a top food layer. The partition members include a separating portion with a perimeter that substantially locally matches a cross-sectional shape of the perimeter portion of the interior. The partition members each further include at least one pulling structure that extends from the separating portion to a grip. The grip may be positioned outside of the interior of the enclosure, at least when the container is in the storage configuration.

45 Claims, 14 Drawing Sheets

(56) References Cited

U.S. PATENT DOCUMENTS 692,618 A * 2/1902 Carr ..... A47F 3/00 217/11
1,032,053 A * 7/1912 Fallon ..... B65D 83/0005 217/64
1,291,082 A * 1/1919 Moses, Jr. ..... B65D 83/0005 122/250 R
1,660,876 A * 2/1928 Macdougall ..... A47F 3/14 206/804
1,710,648 A 4/1929 Thompson
1,789,773 A * 1/1931 Rasch ..... B65D 83/005 206/761
1,811,772 A * 6/1931 Willoughby ..... B65D 57/00 206/499
RE18,426 E 4/1932 Willoughby
1,904,741 A * 4/1933 Lorber ..... A21D 10/025 206/499
1,950,265 A * 3/1934 Peterson ..... B65D 83/005 206/761
1,985,516 A * 12/1934 Parr ..... B65D 5/5213 206/761
2,334,595 A * 11/1943 Bailey ..... B65D 83/005 249/74
2,502,635 A 4/1950 Swartz
2,520,522 A 8/1950 Adams
2,582,655 A 1/1952 Schenk
2,676,890 A 4/1954 Thomas et al.
2,695,847 A 11/1954 Fisher
2,791,362 A 5/1957 Nute
2,811,455 A 10/1957 Erekson
2,813,033 A 11/1957 Schneider
2,866,420 A 12/1958 Nutty
2,890,122 A 6/1959 Katon
2,896,837 A 7/1959 Risucci
2,902,804 A * 9/1959 Meulemans ..... A01J 27/04 425/138
3,029,750 A 4/1962 Burt, Jr. et al.
3,039,667 A 6/1962 Kozlik
3,044,886 A 7/1962 Mayer et al.
3,057,536 A 10/1962 Warnsdorfer, Jr. et al.
3,086,692 A 4/1963 Cage
3,144,190 A 8/1964 Holt et al.
3,182,890 A * 5/1965 Elam ..... B65D 3/264 206/446
3,445,237 A * 5/1969 Lester ..... A23F 5/125 206/0.5
3,730,739 A * 5/1973 Austin et al. ..... B65D 57/00 206/449
3,771,713 A 11/1973 Davidson
3,967,773 A 7/1976 Kaufmann
4,001,439 A 1/1977 Zonni et al.
4,069,348 A * 1/1978 Bush ..... B65B 11/50 206/471
4,179,040 A * 12/1979 Bateman ..... A47G 19/30 206/804
4,817,803 A 4/1989 Risucci
5,115,624 A * 5/1992 Garwood ..... B65B 11/50 426/404
5,417,329 A 5/1995 Whitman
5,671,856 A 9/1997 Lisch
5,950,913 A 9/1999 Rea et al.
6,092,717 A 7/2000 Lowry
D436,861 S 1/2001 Sagel et al.
6,296,885 B1 10/2001 Robertson
6,305,275 B2 10/2001 Grassier et al.
6,338,864 B1 1/2002 Deering et al.
6,582,828 B1 6/2003 Kaschel
6,722,526 B1 4/2004 Passetti
6,722,871 B1 4/2004 Howe et al.
6,889,837 B2 5/2005 Soehnlen et al.
6,966,450 B2 11/2005 Askew
7,219,830 B2 5/2007 West
8,800,802 B2 8/2014 Martin
8,844,758 B1 9/2014 Kummer
8,939,310 B1 1/2015 Stravitz
2001/0026820 A1 10/2001 Hentzel
2002/0017074 A1* 2/2002 Sireix ..... B31B 43/00 53/287
2006/0101956 A1 5/2006 Hermansen et al.
2008/0063325 A1* 3/2008 Miller ..... B65D 75/20 383/211
2008/0248171 A1 10/2008 Edens
2011/0284550 A1 11/2011 Gersovitz
2013/0089643 A1* 4/2013 Chapman ..... B65D 85/76 426/119
2013/0259979 A1 10/2013 Pucci
2014/0314903 A1 10/2014 Iwegbu

FOREIGN PATENT DOCUMENTS

EP 2692253 A1 9/2016
GB 1157108 7/1969
WO 2011086058 A1 7/2011

OTHER PUBLICATIONS

KB—Philip R's Frozen Desserts pre-portioned, pre-scooped ice cream and sorbet—www.icecream-desserts.com—Jul. 3, 2012.

* cited by examiner

130
$150_3$
118
110
$150_6$
140
$200_{10}$
$D_6$
$D_5$
$D_4$
$200_t$
D 500
502
504
506
200P
200r
200F
$200_1T$
$200_1$
$200_2$
$200_3$
$200_4$
$200_5$
$200_6$
$D_0$
$D_1$
$D_2$
$D_3$
$200_1B$
$200_2T$
$200_2B$
$200_6T$
200L
$200_6B$
150t

PARTITIONED FOOD PACKAGE

CROSS-REFERENCE TO RELATED APPLICATION

This application claims the benefit of U.S. Provisional Application No. 61/778,308, filed Mar. 12, 2013.

BACKGROUND

Food packaging has been developed over time to facilitate convenient transportation, storage, and serving of foods. For example, ice cream is often sold around the world (especially in developed countries) in containers with removable lids that may be resealed and/or reattached to the container. Ice cream has also been packaged in containers suitable for a single serving size and can be eaten directly out of the container. Such single serving packaging is typically inefficient in terms of packaging material use. Ice cream can be susceptible to freezer burn, especially once the package has been opened, even with the lid reapplied. Ice cream packaging may come in many shapes (e.g., cylindrical-shaped, scround-shaped, pail-shaped, and box-shaped). Heavy ice cream (e.g., premium and super premium ice cream), at cold temperatures, in bulk packaging, may be difficult to serve, as the ice cream may be quite hard. When a portion of hard ice cream is served from a larger volume of hard ice cream, the serving difficulty may be further increased. A type of food including a slab of food sandwiched in between an upper and a lower piece of food, for example an ice cream sandwich, is known.

SUMMARY

Certain aspects of the present disclosure relate to a container for food. The container includes an enclosure, a lid, and a partition member. The enclosure includes an interior with a base portion and a perimeter portion. The perimeter portion of the interior extends between the base portion of the interior and an opening of the enclosure. The lid may be adapted to cover the opening of the enclosure when the container is in a storage configuration. The lid may also be adapted to uncover the opening of the enclosure when the container is in a serving configuration. In certain embodiments, the partition member may be adapted to separate a first food layer from a second food layer. The partition member may include a separating portion with a perimeter that substantially matches a cross-sectional shape of the perimeter portion of the interior of the enclosure. The partition member further includes at least one pulling structure that extends from the separating portion to a grip. The grip may be positioned outside of the interior of the enclosure at least when the container is in the storage configuration.

In certain embodiments, the perimeter portion may be a revolved shape. The revolved shape may be cylindrical. The opening of the enclosure may be positioned opposite the base portion of the interior of the enclosure.

In certain embodiments, the lid may be completely removed from the enclosure when the container is in the serving configuration. In certain embodiments, the lid may be attached to the enclosure when the container is in the storage configuration. In certain embodiments, the lid may remain attached to the enclosure when the container is in the serving configuration. In certain embodiments, the lid includes a lip. The perimeter portion of the interior terminates at an edge that may surround the opening of the enclosure, and the lip of the lid may surround the edge of the perimeter portion when the container is in the storage configuration. The grip of the pulling structure may be positioned between an interior surface of the lip of the lid and an exterior of the enclosure. In certain embodiments, the at least one pulling structure may be hooked over the edge, at least when the container is in the storage configuration. The perimeter portion of the interior of the enclosure may include a rolled edge. In certain embodiments, the rolled edge may roll outwardly away from the interior of the enclosure.

In certain embodiments, a pocket may be formed by the interior surface of the lip of the lid, the rolled edge, and the exterior of the enclosure when the container is in the storage configuration. In certain embodiments, the grip of the pulling structure may be positioned within the pocket when the container is in the storage configuration. In certain embodiments, the grip may be positioned on a handle of the pulling structure and the handle may be positioned within the pocket when the container is in the storage configuration.

In certain embodiments, the handle may be formed by a pair of the pulling structures. In certain embodiments, the partition member may include at least a pair of the pulling structures. The pair of the pulling structures may be positioned opposite each other. In certain embodiments, the pair of the pulling structures may be joined together to form a handle. In certain embodiments, the partition member may include two pairs of the pulling structures. A first pair of the two pairs of the pulling structures may be joined together to form a first handle. A second pair of the two pairs of the pulling structures may be joined together to form a second handle.

In certain embodiments, the partition member may include a plurality of the pulling structures. The pulling structures may be positioned adjacent the perimeter portion of the interior. In certain embodiments, the pulling structures may be positioned to adjoin the perimeter portion of the interior. In certain embodiments, the separating portion and the pulling structures may be formed from a single sheet of material.

In certain embodiments, the perimeter of the separating portions may substantially seal with the perimeter portion of the interior of the enclosure. The perimeter of the separating portions may form a seal with the perimeter portion of the interior of the enclosure. The seal may protect the second food layer from freezer burn. The seal may protect the second food layer from freezer burn after the first food layer has been removed from the interior of the enclosure.

In certain embodiments, the partition member may be a first partition member, and the container may further include a second partition member. The second partition member may be adapted to separate the second food layer from a third food layer. In certain embodiments, the second partition member includes a separating portion with a perimeter that substantially matches the cross-sectional shape of the perimeter portion of the interior of the enclosure. The second partition member may further include at least one pulling structure that extends from the separating portion of the second partition member to a grip of the second partition member. The grip may be positioned outside of the interior of the enclosure. The at least one pulling structure of the second partition member may extend through an interface between the perimeter of the separating portion of the first partition member and the perimeter portion of the interior of the enclosure.

In certain embodiments, the container may further include a third partition member that may separate the third food layer from a fourth food layer. The third partition member may include a separating portion with a perimeter that may substantially match the cross-sectional shape of the perimeter portion of the interior of the enclosure. The third partition member may further include at least one pulling structure that extends from the separating portion of the third partition member to a grip of the third partition member. The grip may be positioned outside of the interior of the enclosure. The at least one pulling structure of the third partition member may extend through an interface between the perimeter of the separating portion of the first partition member and the perimeter portion of the interior of the enclosure and may also extend through an interface between the perimeter of the separating portion of the second partition member and the perimeter portion of the interior of the enclosure.

In certain embodiments, the partition member may be one of a plurality of partition members that include at least one pulling structure. The plurality of partition members separate a plurality of food layers, respectively, and each of the pulling structures of the plurality of partition members may extend to a grip that may be positioned outside of the interior of the enclosure. In certain embodiments, each of the pulling structures of the plurality of partition members may extend to a different length. In certain embodiments, each of the grips of the pulling structures of the plurality of partition members may be spaced from the opening of the enclosure substantially the same. In certain embodiments, each of the pulling structures of the plurality of partition members may be positioned along a different path and therefore not overlap each other. In certain embodiments, the different paths may be rotationally spaced from each other about an axis of the enclosure.

In certain embodiments, the container includes a base partition member that may separate the second food layer from the base portion of the interior. The base partition member may include a separating portion with a perimeter that substantially matches the cross-sectional shape of the perimeter portion of the interior of the enclosure. The base partition member may further include at least one pulling structure that may extend from the separating portion of the base partition member to a grip of the base partition member positioned outside of the interior of the enclosure. The pulling structure of the base partition member may extend through an interface between the perimeter of the separating portion of the partition member and the perimeter portion of the interior of the enclosure.

In certain embodiments, the container includes an opening partition member that may separate the lid from the first food layer when the container is in the storage configuration. The opening partition member may include a separating portion with a perimeter that may substantially match the cross-sectional shape of the perimeter portion of the interior of the enclosure. The opening partition member may further include at least one pulling structure that may extend from the separating portion of the opening partition member to a grip of the opening partition member. The grip may be positioned outside of the interior of the enclosure. The pulling structure of the partition member may extend through an interface between the perimeter of the separating portion of the opening partition member and the perimeter portion of the interior of the enclosure.

Other aspects of the present disclosure relate to a method of serving food from a container. The method includes: 1) providing the container with layers of the food respectively separated by partition members; 2) positioning a serving utensil at a first side of one of the layers of the food; 3) applying a force on the serving utensil and thereby shearing through the one of the layers of the food with the serving utensil from the first side to a second side of the one of the layers of the food; and, 4) removing a portion of the one of the layers of the food from the container. One of the partition members is positioned adjacent the second side of the one of the layers of the food.

In certain embodiments, a magnitude of the force that is applied to the serving utensil for shearing is reduced by the one of the partition members that is positioned adjacent the second side of the one of the layers of the food.

In certain embodiments, the method further includes removing the one of the partition members that is positioned adjacent the second side of the one of the layers of the food thereby exposing another of the layers of the food. A grip may be positioned outside of an interior of the container. The grip may be connected to the one of the partition members. The removing of the one of the partition members may include pulling on the grip.

In certain embodiments, the food is a hard frozen food. The hard frozen food may be a premium ice cream, a sherbet, a sorbet, a gelato, etc.

Still other aspects of the present disclosure relate to a method of storing food in a container. The method includes: 1) providing the container with layers of the food separated by partition members, respectively; 2) removing a first layer of the layers of the food and thereby exposing a first partition member of the partition members; 3) protecting a second layer of the layers of the food with the first partition member during a first storage period; 4) removing the second layer of the layers of the food and thereby exposing a second partition member of the partition members; and, 4) protecting a third layer of the layers of the food with the second partition member during a second storage period.

In certain embodiments, the partition members may be in direct physical contact with the layers of the food that are adjacent to the partition members, respectively.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

BRIEF DESCRIPTION OF THE FIGURES

Example embodiments and uses of food packaging, according to the principles of the present disclosure, are illustrated in the figures.

DETAILED DESCRIPTION

Figure 1:
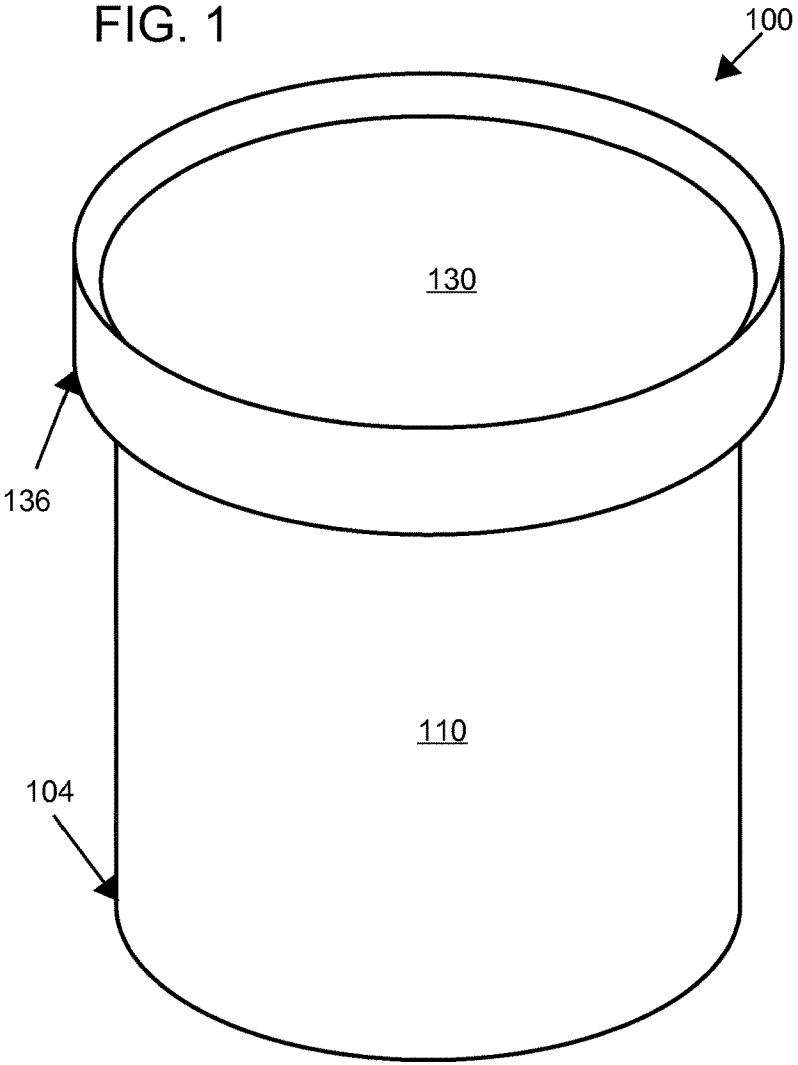
FIG. 1 is a perspective view of an example container, including an enclosure covered by a lid.
Figure 3:
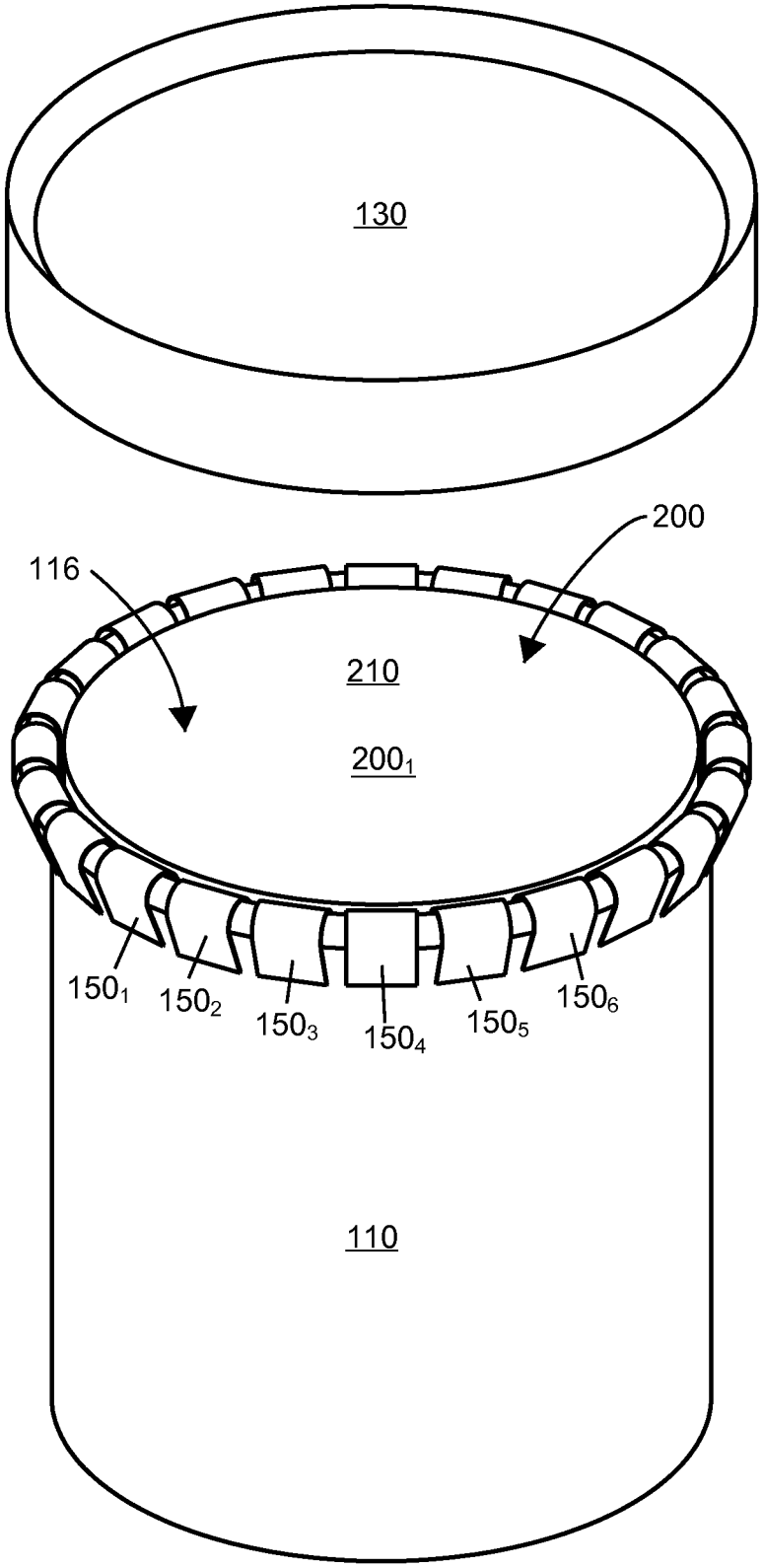
FIG. 3 is the perspective view of FIG. 1, but with the lid of FIG. 1 removed from the enclosure of FIG. 1, illustrating the straps of FIG. 2 curling over an edge of an opening of the enclosure of FIG. 1, thereby providing easy access to the straps.
Figure 20:
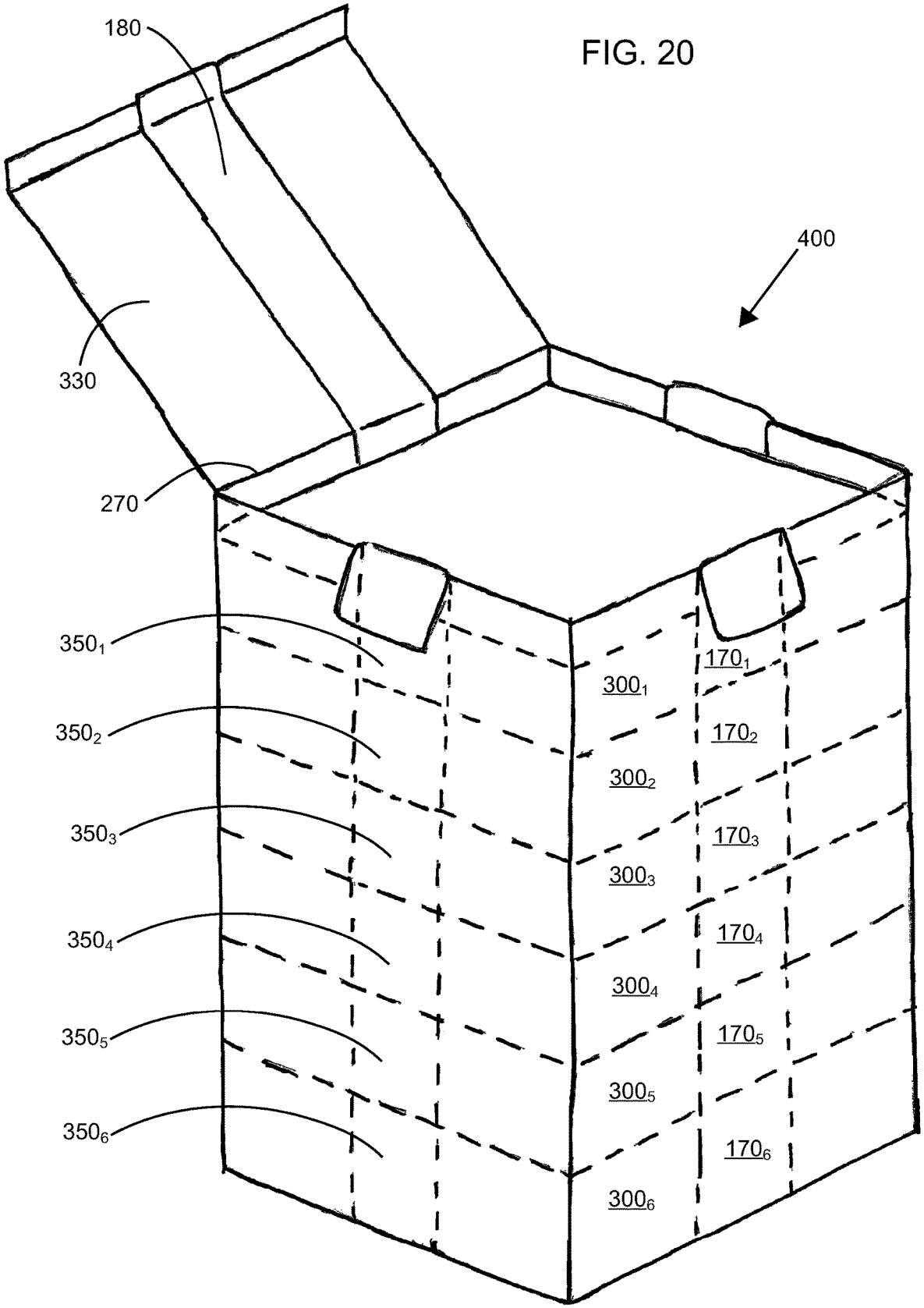
FIG. 20 is the perspective view of FIG. 1 with another example container including an enclosure covered by a hinging lid and including the straps of FIG. 2.

According to the principles of the present disclosure, a food package 100 includes a container 110 (e.g., a bucket, a pail, an enclosure, a vessel, etc.) and a lid 130 (e.g., a cover, a top, a cap, etc.), as illustrated at FIG. 1. The food package 100 may be used to facilitate storage, shipping, handling, and serving of a food 200 such as a ice cream, a sherbet, a sorbet, a yogurt, etc. The food 200 may include a frozen confection, etc. When used for storage, shipping, handling, etc., the lid 130 is typically positioned over an opening 116 (e.g., a gap, a hole, etc.) of the container 110. The lid 130 fits over a portion of an exterior 142 of the container 110. When serving the food 200 from the food package 100, the lid 130 is typically removed from the container 110 (as shown at FIG. 3) or hinged away from the container 110 (as shown at FIG. 20) thereby exposing the opening 116 and the food 200.

To remove the food 200 from the food package 100, a serving utensil 500 (e.g., a spoon, a scoop, a fork, etc.) may be inserted through the opening 116. A leading portion 506 of the serving utensil 500 (see FIG. 10) penetrates the food 200. The serving utensil 500 may be rotated or otherwise moved and thereby separate a portion 200*p* of the food 200 from a remaining portion 200*r* of the food 200. On solid or semi-solid foods such as ice cream, a void 140 may be left in the remaining portion 200*r* upon removing the removed portion 200*p* (i.e., portion to be removed).

Figure 2:
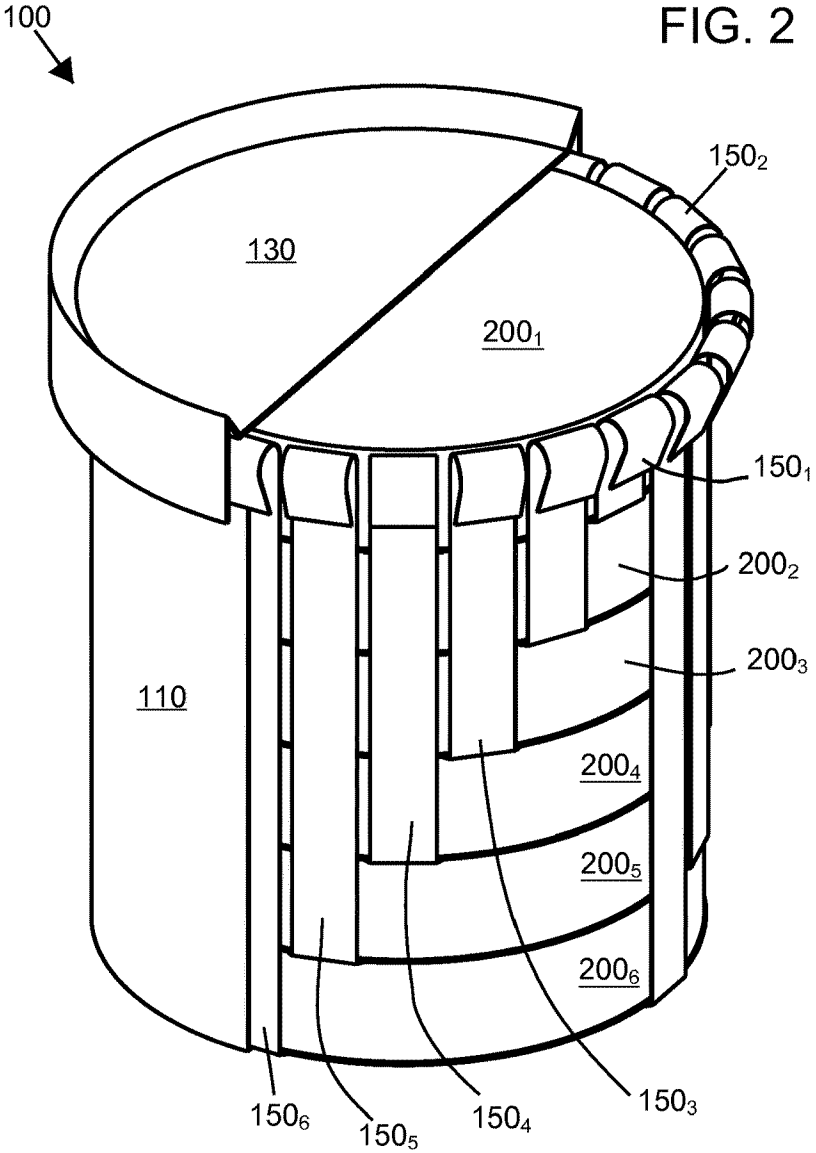
FIG. 2 is the perspective view of FIG. 1, but with half of the enclosure and the lid of FIG. 1 cut-away, revealing a plurality example partitions, with example straps connected to the partitions, and a plurality of food portions separated by the partitions.

Turning now to FIG. 2, the lid 130 and the container 110 are shown half cut-away, thereby revealing a series of partitions $\mathbf{150}_{1\text{-}6}$ along with a series of food portions $\mathbf{200}_{1\text{-}6}$ (e.g., food slabs, food layers, etc.) of the food 200. As depicted, the food portions $\mathbf{200}_{1\text{-}6}$ are substantially arranged between various depths $D_{0\text{-}6}$ (see FIG. 10). For example, food portion $\mathbf{200}_1$ is a first food portion 200F (e.g., a top food portion) and is positioned at or near or adjacent a top 118 of an interior 114 (e.g., inside of container, etc.) (see FIG. 12) of the container 110. In particular, a top $\mathbf{200}_1$T of the food portion $\mathbf{200}_1$ (see FIG. 10) is substantially positioned a depth $D_0$ from the top 118, and a bottom $\mathbf{200}_1$B of the food portion $\mathbf{200}_1$ is substantially positioned a depth $D_1$ from the top 118. The depth $D_0$ may be zero. In turn, the top $\mathbf{200}_2$T of the food portion $\mathbf{200}_2$ is substantially positioned the depth $D_1$ from the top 118, and a bottom $\mathbf{200}_2$B of the food portion $\mathbf{200}_2$, which is substantially positioned a depth $D_2$ from the top 118. This may correspondingly continue until a last food portion 200L (i.e., a bottom food portion, a base food portion, etc.). In the depicted embodiment, food portion $\mathbf{200}_6$ is the last food portion 200L and is positioned at or near or adjacent a bottom 108 (i.e., a base) of the interior 114 of the container 110. The last partition $\mathbf{150}_6$ is adjacent or adjoins the bottom 108. In particular, a top $\mathbf{200}_6$T of the food portion $\mathbf{200}_6$ is substantially positioned a depth $D_5$ from the top 118, and a bottom $\mathbf{200}_6$B of the food portion $\mathbf{200}_6$ is substantially positioned a depth $D_6$ from the top 118. The depth $D_6$ may be substantially equal to a depth D of the interior 114 of the container 110. Intermediate food portions $\mathbf{200}_{2\text{-}5}$ are sequentially positioned between the first food portion 200F (e.g., the food portion $\mathbf{200}_1$) and the last food portion 200L (e.g., the food portion $\mathbf{200}_6$). In the depicted embodiments, a thickness 150*t* of the partitions $\mathbf{150}_{0\text{-}6}$ is much smaller than a thickness 200*t* of the food portions $\mathbf{200}_{1\text{-}6}$. Thus, adjoining tops $\mathbf{200}_{1\text{-}6}$T and bottoms $\mathbf{200}_{1\text{-}6}$B of adjacent food portions 200 (e.g., the bottom $\mathbf{200}_1$B and the top $\mathbf{200}_2$T) are substantially at the same position (i.e., location). As used herein, "substantially at the same position", "substantially positioned", etc. indicates within 2 percent of the thickness 200*t* or within about 0.01 inch. It is understood that the tops $200_1$T-$200_6$T of the food portions $200_{1-6}$ may not be flat within 2 percent of the thickness 200*t* or flat within about 0.01 inch.

As used herein, the terms "top" and "bottom" are generally used to establish relative orientations, unless otherwise noted. It shall be appreciated that orientations other than those shown in the example illustrations are contemplated and possible. For example, the food package 100 may have a horizontal orientation, and the opening 116 may be positioned and/or accessed from a side of the food package 100.

Turning now to FIG. 3, the lid 130 is shown removed (e.g., vertically spaced) from the container 110. As depicted, the first food portion $200_1$ is shown exposed through the opening 116. In particular, an exposed surface 210 of the first food portion $200_1$ is accessible through the opening 116 and is immediately ready to interface with the serving utensil 500. In other embodiments (see FIG. 14), an initial partition $150_0$ separates the food portion $200_1$ from an inside 136 of the lid 130. In this picture, the lid 130 is shown completely unattached, however the lid 130 could include configurations such as being on a hinge 270, or being otherwise attached.

The partitions $150_{0-6}$ include a partition tray 160 (e.g., a separating portion, a main portion, a separator, a food support member, etc.). In the depicted embodiment, the partition tray 160 extends substantially across the interior 114 of the container 110 and around a perimeter 104 of the container 110 at the particular depth. The partition $150_0$ could be placed on top of the portion $200_1$ to provide it with extra protection from freezer burn, or for any other reason. Straps 170 (e.g., tabs, ribbons, rods, belts, strips, strings, pulling structures, lifting structures, etc.) may be present on the partition tray 160. The straps 170 may be removed as well. In the figures, the straps 170 are shown arranged around the perimeter 104. In FIGS. 15-18 the straps 170 and all of their corresponding parts contain two subscripts. A first subscript denotes the corresponding partition 150 that the strap 170 is attached to, and a second subscript denotes the position of the strap 170 around the partition 150.

Figure 4:
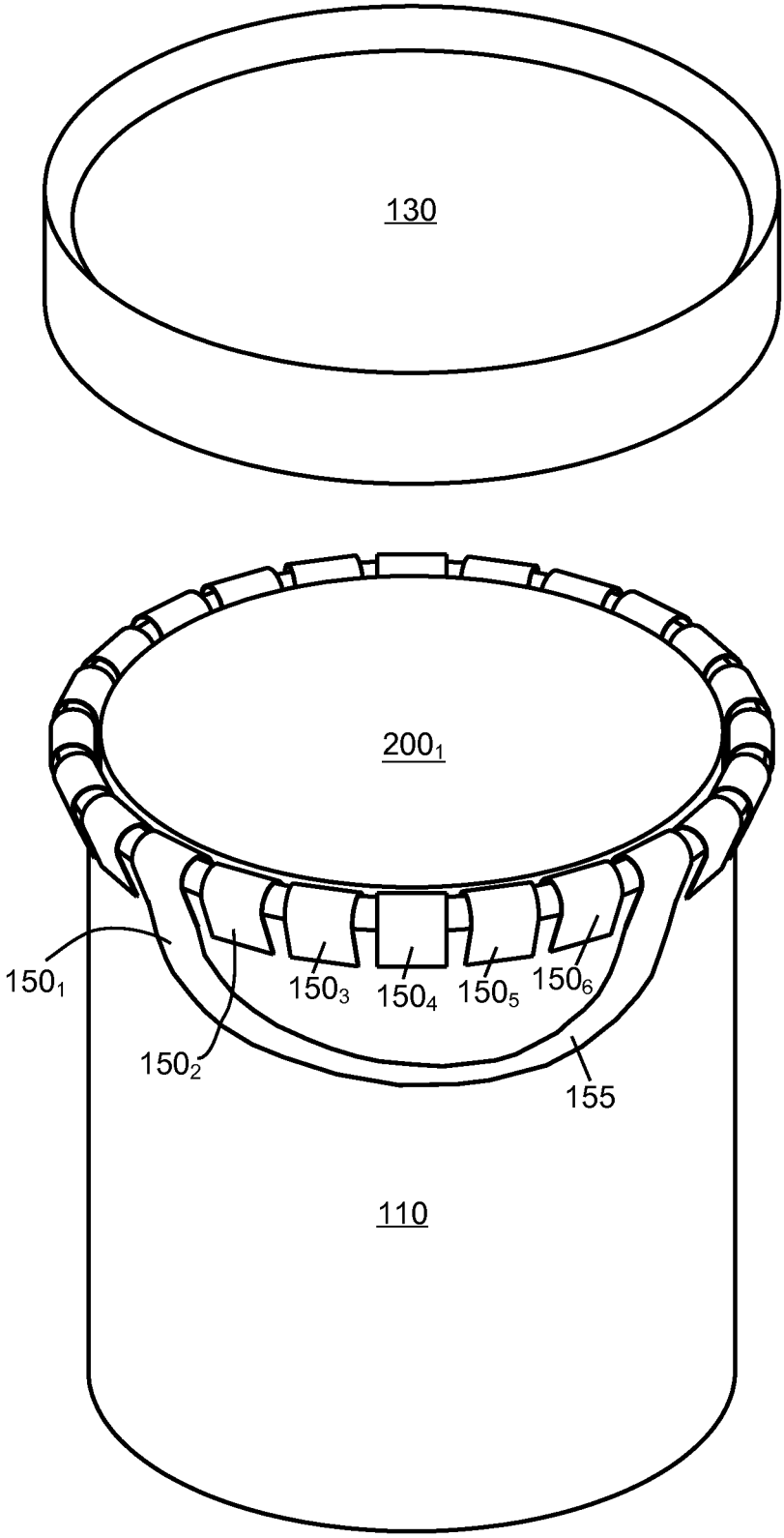
FIG. 4 is the perspective view of FIG. 3, but with a pair of the straps of FIG. 2 connected by an example handle.

Turning now to FIG. 4, an alternative embodiment of the partitions 150 is shown. The alternative embodiment further forms the straps 170 into a handle 155 (e.g., handhold, grip, etc.). The handles 155 and/or the straps 170 could be numbered, or otherwise marked to indicate the food portion 200 to which they correspond. The handles 155 of the alternative embodiment could be included on all partitions 150, or could be included on only certain partitions 150. The handle 155 could be used to facilitate easier serving, or used to add to the strength of the straps 170. An example of this is that it may be easier to grip the handle 155, than it would be to grip the straps 170. Depending on the number of straps 170 used, the number of the handles 155 could vary from one, two, three, or even more per partition 150. As illustrated at FIG. 4, the handles 155 are in a stored configuration. In the stored configuration, the handles 155 may be stacked on top of each other, or the handles 155 may be angled slightly apart from each other. Although the handles 155 are illustrated as being formed from the straps 170, the handles 155 could be formed separately and connected to the straps 170. The handles 155 may be stored within an interior 111 of the lid 130.

Figure 5:
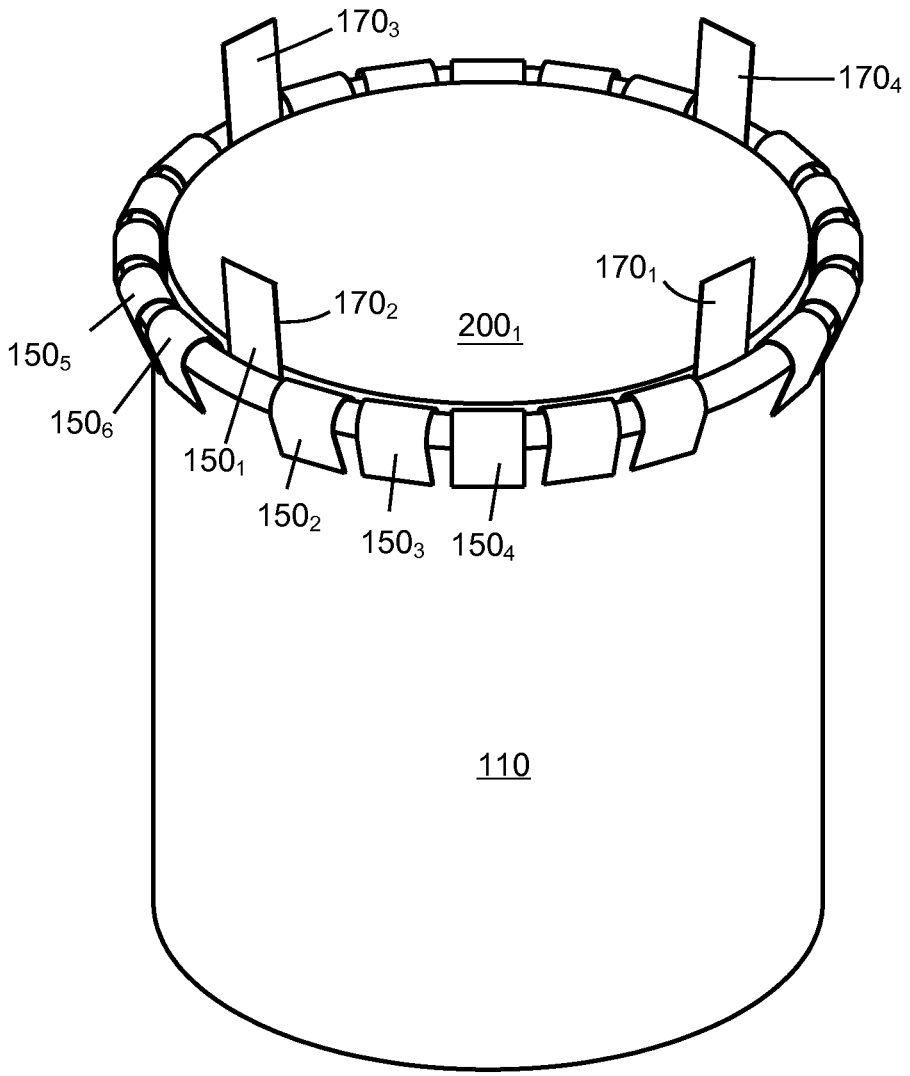
FIG. 5 is the perspective view of FIG. 1, but with the lid of FIG. 1 removed and the straps of FIG. 2 of a first partition of the example partitions of FIG. 2 pulled up and ready to be grasped by someone for pulling out a first food portion of the example food portions of FIG. 2.

Turning now to FIG. 5, straps $170_{1-4}$ are all connected to partition $150_1$. All of the straps $170_{1-4}$ are illustrated pulled away from a lip 112 (e.g., edge, rolled edge, etc.) of the container 110. The straps 170 are lifted up in this way in order to make it easier to pull out the food portion $200_1$. By pulling on the straps $170_{1-4}$ that are connected to partition $150_1$, one would achieve pulling out the whole of partition $150_1$, along with the food portion $200_1$.

Figure 6:
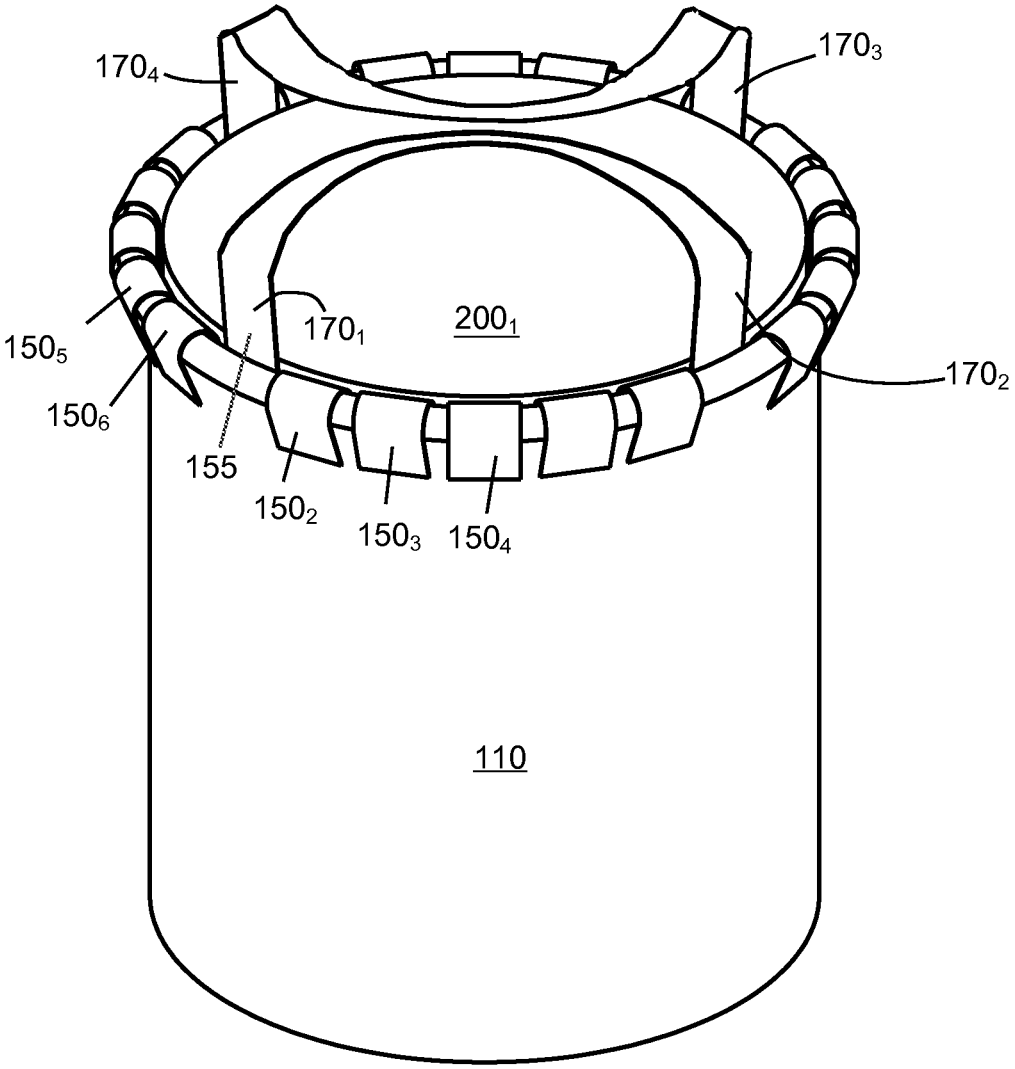
FIG. 6 is the perspective view of FIG. 1, but with the lid of FIG. 1 removed and the straps of FIG. 2 and the example handle of FIG. 4 of the first partition of the example partitions of FIG. 4 pulled up and ready to be grasped for pulling out the first food portion of FIG. 5.

Turning now to FIG. 6, the alternate embodiment of the partition 150, introduced at FIG. 4, is illustrated with the straps $170_{x1-x2}$ and straps $170_{x3-x4}$ formed into the handles 155, respectively. The handle 155 could either be folded over the food 200, or be folded over the lip 112 of the container 110. As shown at FIG. 6, the handles 155 formed from the straps $170_{x1-x2}$ and straps $170_{x3-x4}$ are in a gripping configuration. Handles similar to the handles 155 could be attached to all partitions 150. The handle 155 is shown slightly elevated from food portion $200_1$ so a consumer may put his/her hand under it and pull up on it, effectively removing the partition $150_1$ from the container along with food portion $200_1$. If desired, the consumer may instead pull on the handles 155 of partition $150_2$. By pulling on partition $150_2$ the consumer would pull the second partition $150_2$ and the food portion $200_2$ out and partition $150_1$ and food portion $200_1$ out as well. A way to stack the partitions 150 with handles 155 effectively would be to position the bottom partition $150_6$ in first, then put the food portion $200_6$ in second, then put in the second partition $150_5$ in third, alternating between the food portions 200 and the partitions 150 until the desired number of food portions 200 is reached. Placing the partitions 150 and the food portions 200 in the way described would prevent the partitions 150 and handles 155 from being tangled; however, other methods of placing partitions 150 and food portions 200 into the food package 100 may also be used.

Figure 7:
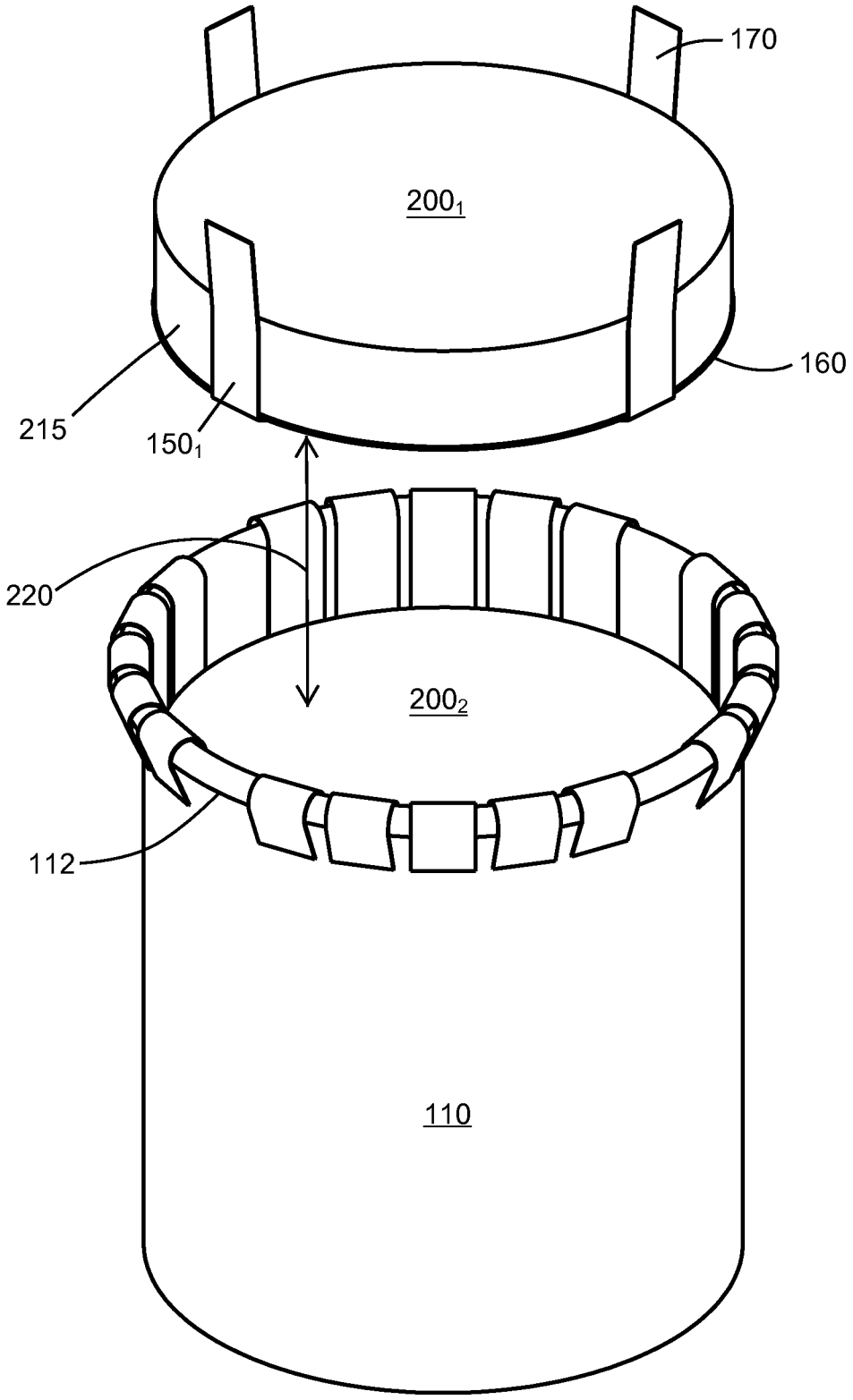
FIG. 7 is the perspective view of FIG. 1, but with the first food portion of FIG. 5 having been pulled out of the enclosure of FIG. 1 by the straps of the first partition of FIG. 6.

Turning now to FIG. 7, the first partition $150_1$, holding the first food partition 200, is shown removed (e.g., vertically spaced) from the container 110 with the straps 170 facing up. The partition tray 160 is elevated a distance 220 away from the top of the food portion $200_2$. This also takes the food portion $200_1$ with it, which makes it possible to serve the food portion $200_1$ easily. If the food portion $200_1$ is not eaten entirely, and there is a portion 200*r* that exists, the food portion 200*r* may be placed back on the partition $150_1$. The consumer may then lift the partition $150_1$ by the straps 170 and place it back into food package 100, place a partition tray 160 from a prior food portion 200 above the food portion 200*r*, then reseal the food package 100 with the lid 130. By placing the above partition 150 on top of the food portion 200*r*, and then resealing it with the lid 130, the food portion 200*r* stays free of freezer burn and may be used at a later date.

Figure 8:
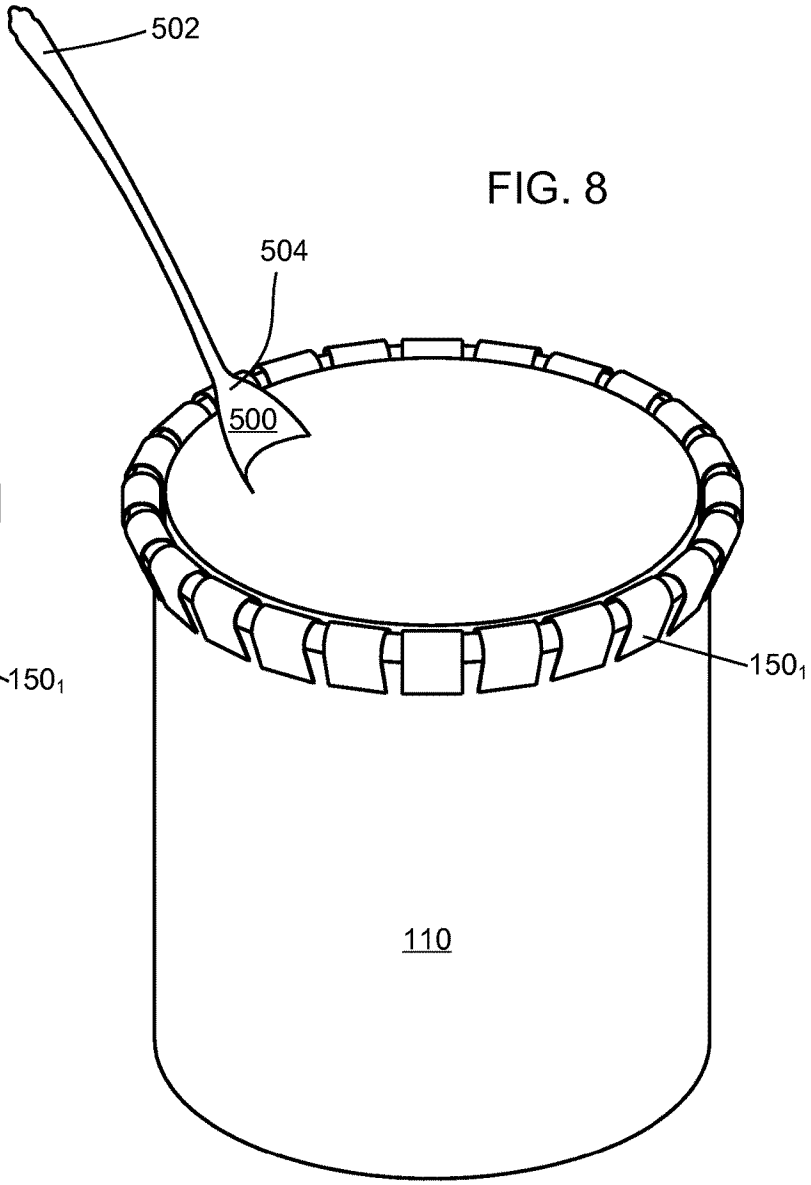
FIG. 8 is the perspective view of FIG. 1, but with the lid removed and a serving utensil piercing the first food portion of FIG. 5. The piercing of the first food portion of FIG. 5 is made easier by an interface between a bottom surface of the first food portion of FIG. 5 and a top surface of the first partition of FIG. 5, which makes for easy scooping.

Turning now to FIG. 8, the serving utensil 500 is shown above the food 200 with the leading part 506 of the spoon 500 inserted into the food 200. Because the food portion $200_1$ is separated from the other food portions $200_{2-5}$ by partition $150_1$, the food portion $200_1$ is easier to scoop and would require less strength by the consumer to serve. The consumer may also use weaker serving utensils 500 without having to worry about bending a handle 502 of the serving utensil 500. The serving utensil 500 may be angled at a shallower angle in order to avoid tearing the partition 150. The last few food portions 200 may need to be pulled out (see FIG. 7) in order achieve the angle of shallowness needed to avoid cutting the partition 150.

Figure 9:
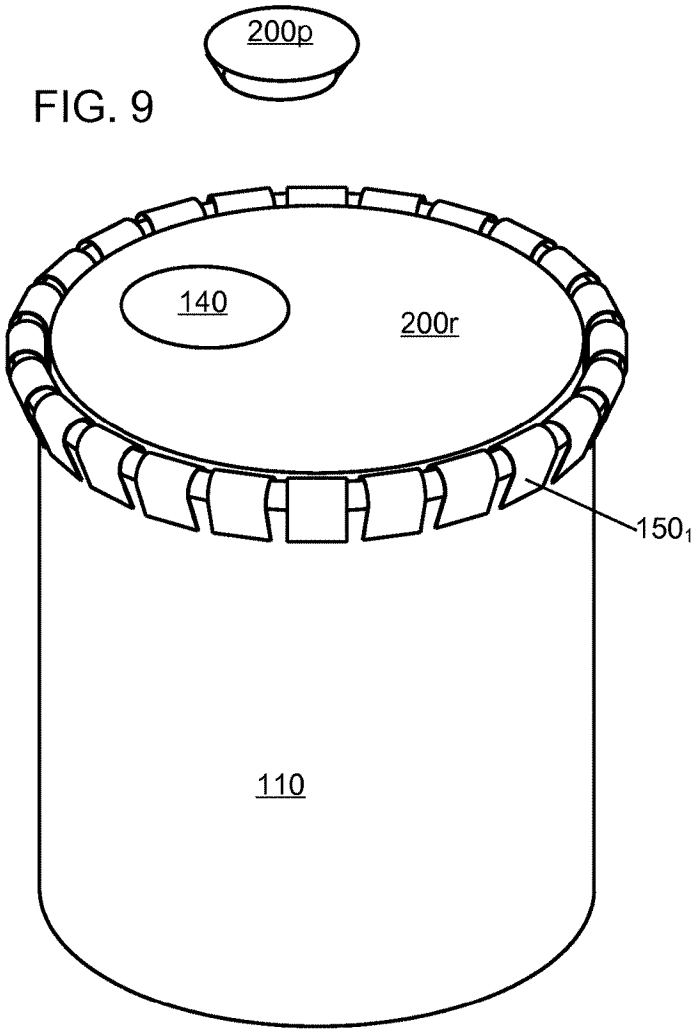
FIG. 9 is the perspective view of FIG. 1, but with a void in the first food portion of FIG. 5 that was left by a chunk of the first food portion of FIG. 5 removed by the serving utensil of FIG. 8, and with the serving utensil of FIG. 8 not shown. The void in the first food portion of FIG. 5 creates a pierced food portion. The void stops at the first partition of FIG. 5.

Turning now to FIG. 9, the removed portion 200*p* of the food 200 is shown above the container 110. Once this first portion 200*p* is removed, it will become increasingly easier to remove the remaining food portions 200*r*, similar to the effect of biting into an apple the first time.

Figures 10, 11:
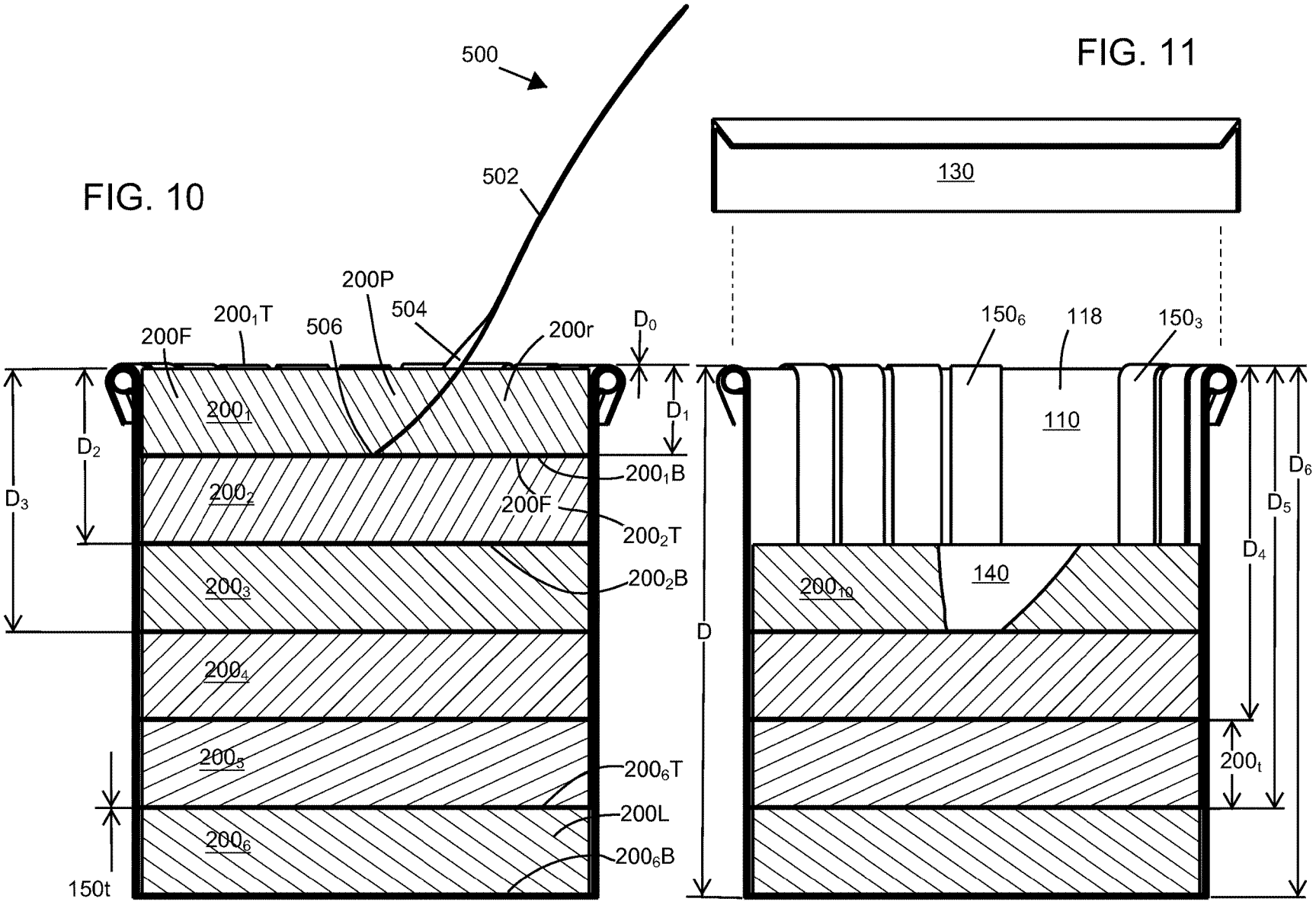
FIG. 10 is a cross-sectional elevation view illustrating the serving utensil of FIG. 8, the pierced food portion of FIG. 9, and the first partition of FIG. 5. The serving utensil of FIG. 8 is positioned for scooping the first food portion of FIG. 5 and stopping at the first partition of FIG. 5 for easier scooping.
FIG. 11 is the cross-sectional elevation view of FIG. 10 illustrating a missing chunk left by the serving utensil of FIG. 8 in a third food portion. The first food portion of FIG. 5, a second food portion, the first partition of FIG. 5, and a second partition have previously been removed.

Turning now to FIG. 10, a cross-sectional elevation view is illustrated, exposing the point in which a tip 506 of the spoon 500 comes into contact with the partition 150. From this view, it can be seen that the lip 112 is slightly above the food portion $\mathbf{200}_1$, creating a space $D_0$ between the lid 130 and the top $\mathbf{200}_1$T of the food portion $\mathbf{200}_1$. The space $D_0$ may be used as an alternative place to store the straps 170, rather than having the straps 170 folded between the gap 120 (e.g., a pocket, etc.) between the container's lip 112 and the perimeter of the lid 134 (see FIG. 11). Having the straps 170 stored in this way could create a cleaner-looking package, protect the straps 170 from falling off, and allow the company to seal the lid 130 on tighter.

Turning now to FIG. 11, the container 110 is shown along with the lid 130 removed (e.g., vertically spaced) from the container 110 in a cross-sectional elevation view, with the portions of food $\mathbf{200}_{1\text{-}2}$ removed. There is a removed food portion 200*p* that represents the shape that the spoon 500 would have left. The cross-sectional elevation view exposes how the removed portion 200*p* ideally would stop at the partition 150. FIG. 11 also displays the lid 130. In this drawing, the lid 130 is completely removable, but the lid 130 could be on the hinge 270. The lid 130 could be placed on top of the partitions 150, causing a loop (e.g., a bend, curve, ect.) 172 to fit in between the gap 120 (see FIG. 14). The gap 120 and the lip 112 may form a pocket 121.

Figure 12:
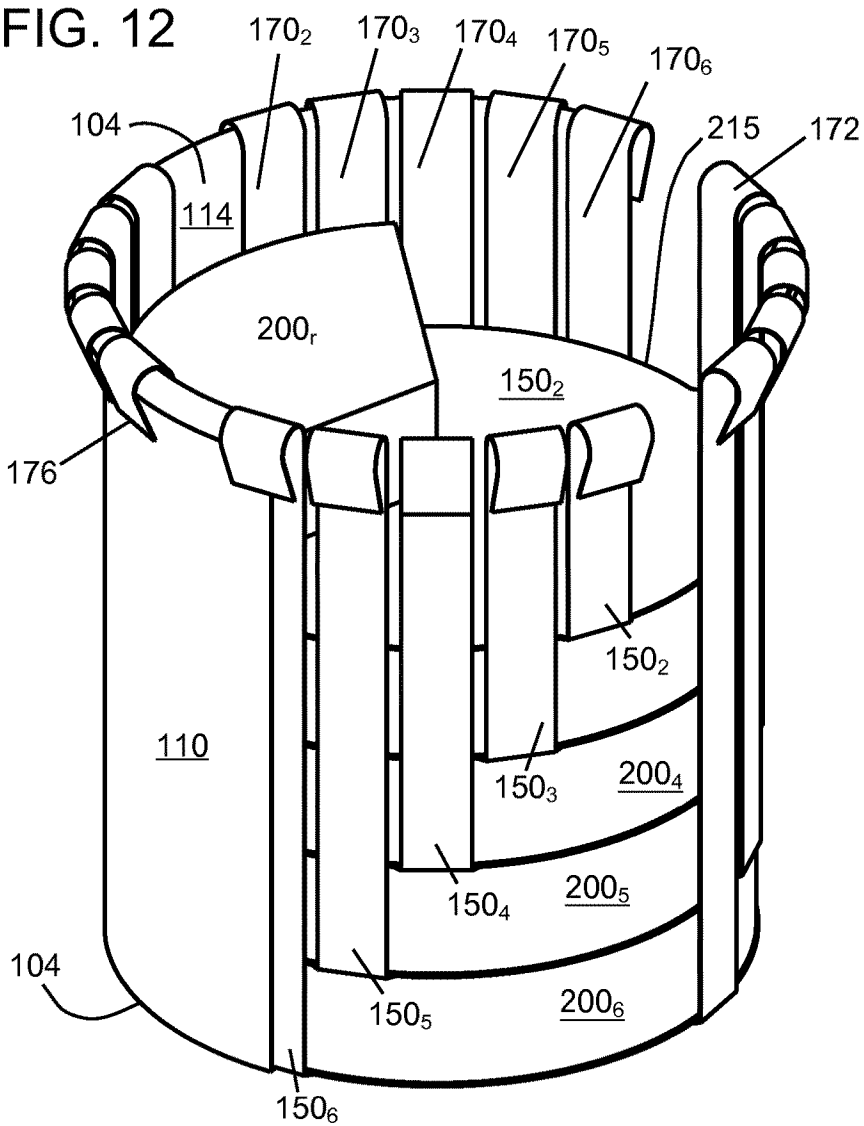
FIG. 12 is the perspective view of FIG. 1, but with the lid of FIG. 1 completely removed, the first food portion of FIG. 5 completely removed, the first partition of FIG. 5 removed, and part of the second food portion of FIG. 11 removed. The second food portion of FIG. 12 has been cut by a cutting utensil.

Turning now to FIG. 12, a perspective view of the food 200 is shown with the lid 130 removed along with half of the container 110 revealing the straps $\mathbf{170}_{x1\text{-}x4}$ and the food portions $\mathbf{200}_{3\text{-}6}$. The straps 170 are seen in between a perimeter of the container 104 (e.g., an edge, etc.) and a perimeter of the food portion 215. All of the straps 170 are pressed against the inside 114 (i.e., the interior) of the container 110. Partition $\mathbf{150}_1$ is not present in this figure because it has been removed, along with the food portion $\mathbf{200}_1$ and straps $\mathbf{170}_{1x}$ of the partition $\mathbf{150}_1$.

Figure 19:
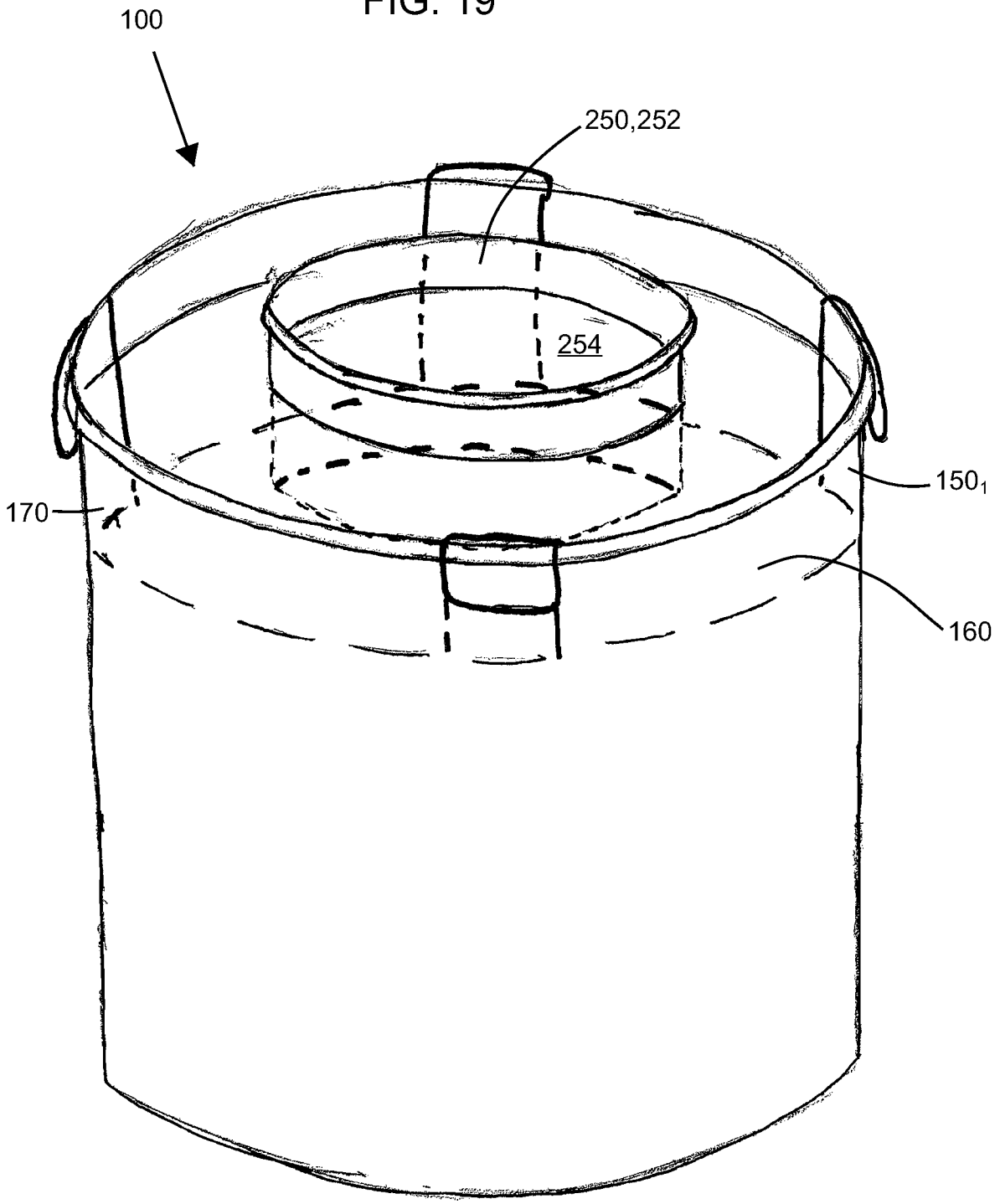
FIG. 19 is the perspective view of FIG. 1 of the container of FIG. 1, with the lid of FIG. 1 removed, illustrating the first food portion of FIG. 5 being cut with a cookie cutter.

As illustrated at FIGS. 12 and 19, there is the removed portion 200*p* that has been removed through use of a cutting utensil 252 (e.g., cookie cutter 250, a chopper, etc.). Through use of the cutting utensil 252, the consumer could serve a measured amount of the food portion 200 that they wish to have. Markings may be placed around the lip 112 of the container 110 measuring out certain units. For example, how many calories each slice had, how many cups of food portion 200 are being served, or how many servings are being served.

Figure 13:
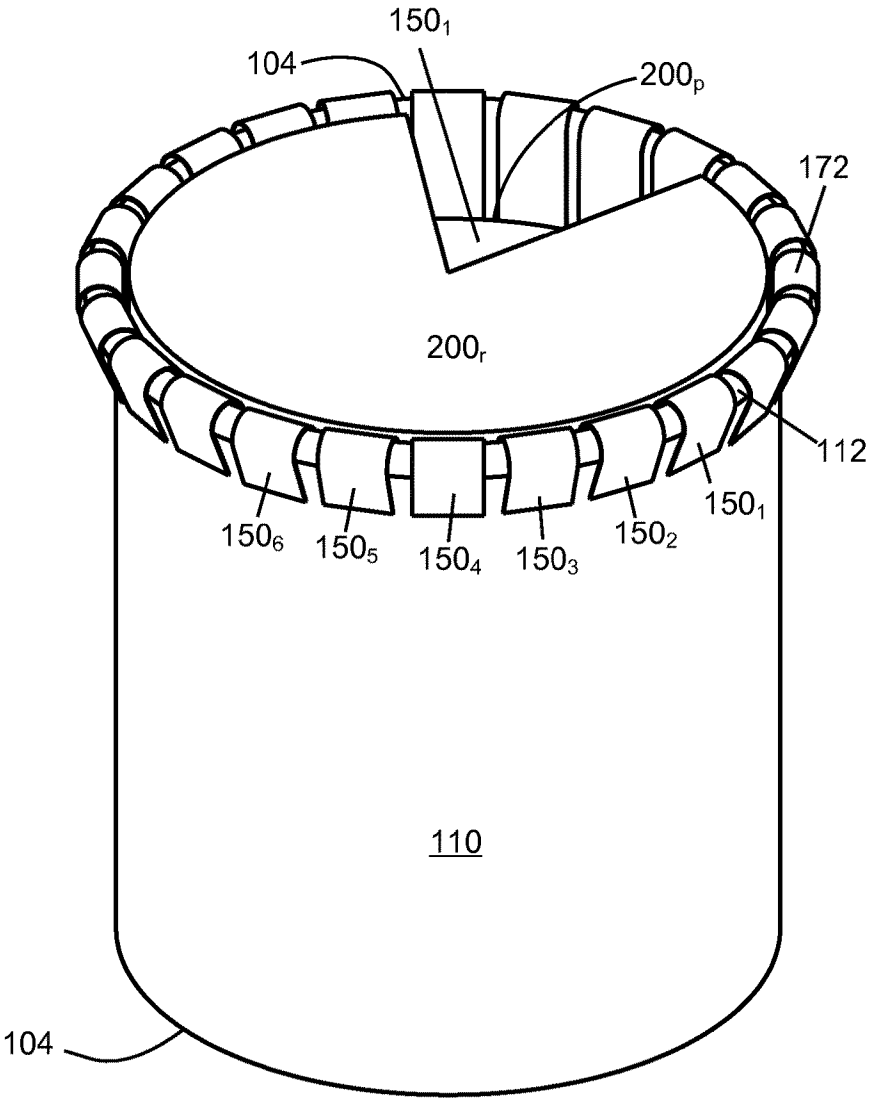
FIG. 13 is the perspective view of FIG. 1, but with the lid of FIG. 1 completely removed, and with part of the first food portion of FIG. 5 removed. The first food partition of FIG. 5 was cut by the cutting utensil of FIG. 12.

Turning now to FIG. 13, the container 110 is shown with the lid 130 removed. There is the removed food portion 200*p* and the remaining food portion 200*r*. All the partitions 150 can be seen around the lip 112 of the container 110.

Figure 14:
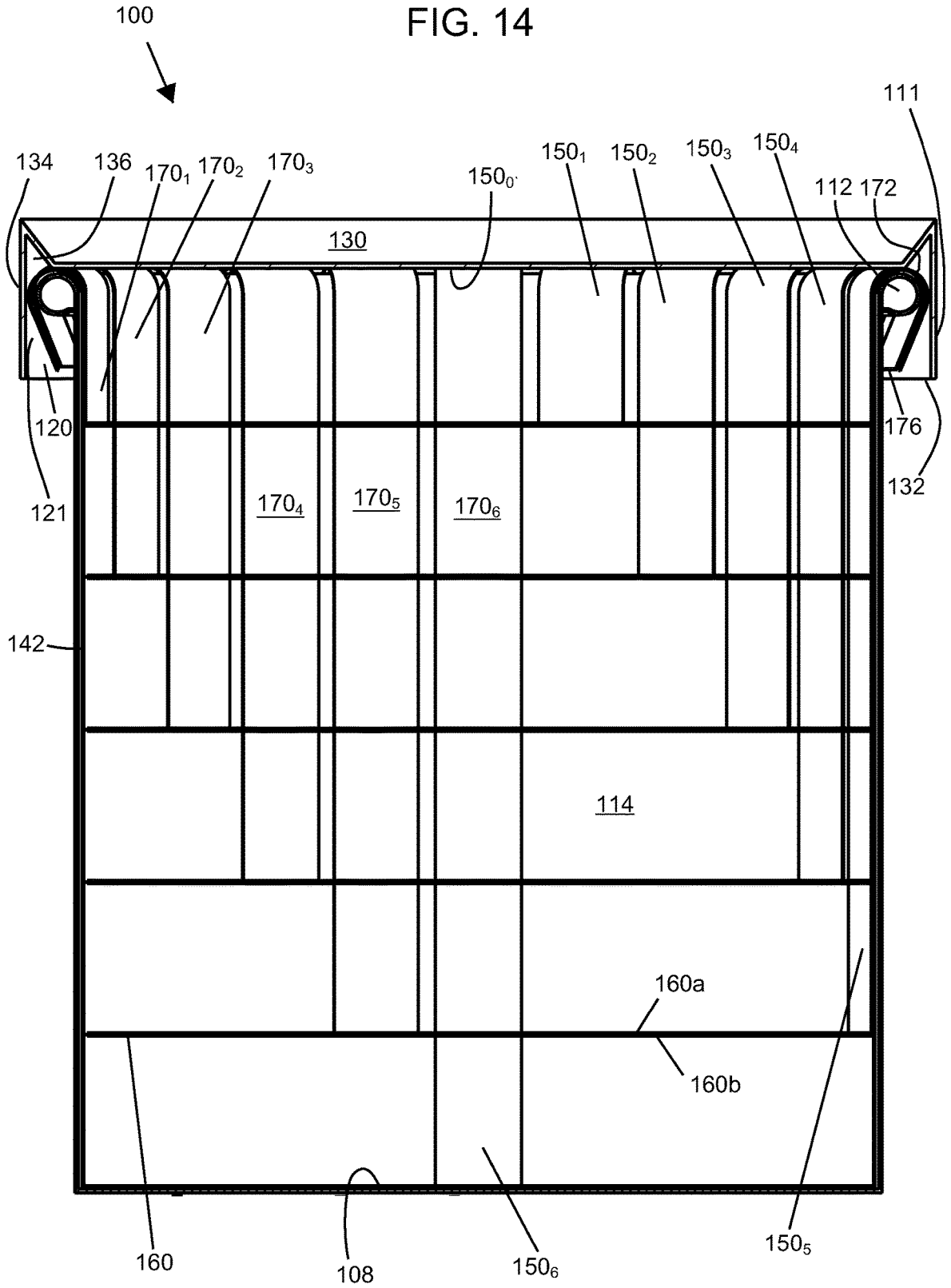
FIG. 14 is the cross-sectional view of FIG. 10, but with the lid of FIG. 1 present and the first food portion of FIG. 5, the second food portion of FIG. 11, and all other food portions removed, exposing some interiors of example straps.

FIG. 14 illustrates a cross-sectional elevation view with all of the food portions 200 removed. The gap 120 is created because the perimeter 134 of the lid 130 is slightly larger than the lip 112 of the container 110. This allows the loop 172 to fit in the gap 120. The end 176 of loop 172 may extend past a bottom edge 132 of the lid 130 (e.g., a bottom perimeter of the lid, etc.), or it may be completely concealed by the perimeter 134 of the lid 130. A top 160*a* of the partition tray 160 and a bottom 160*b* of the partition tray 160 are spaced a distance 150*t* apart, and represent a thickness 150*t* of the partitions 150. There also may be more than one partition 150 in between the food portions 200. The inside surface 111 of the lid 130 helps hold the end 176 of the straps 170 in place. A grip may be included at the end 176 of the strap 170.

Figure 15:
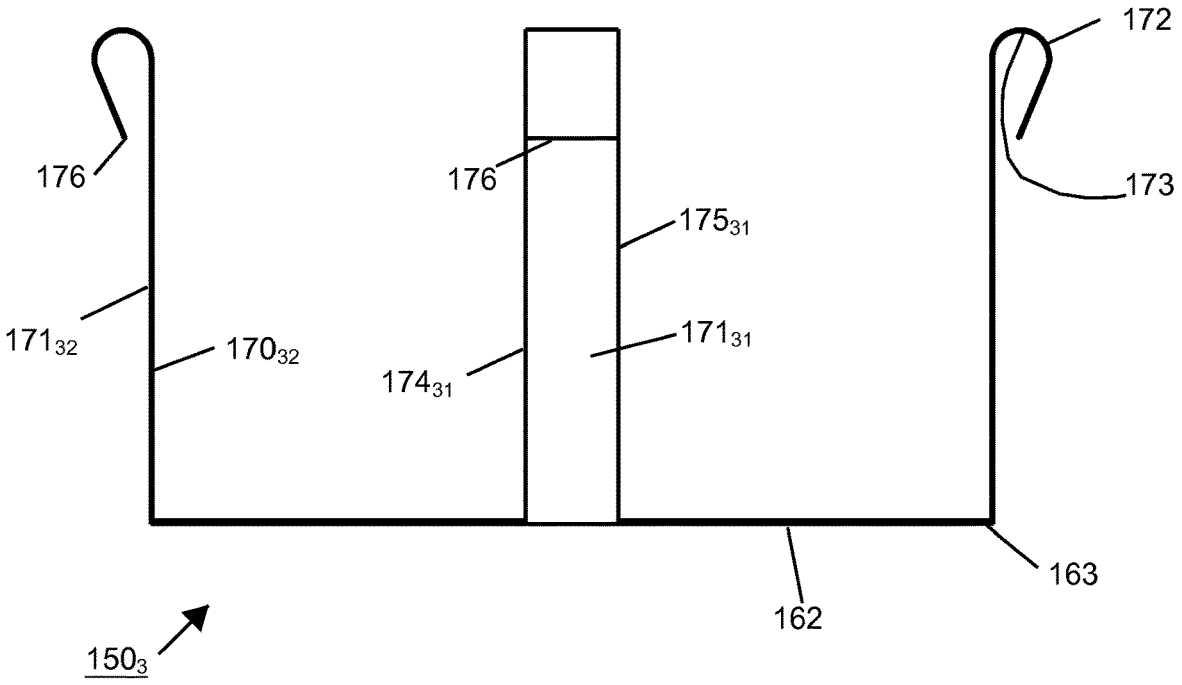
FIG. 15 is a side view of a single partition. The view shows certain of the straps of FIG. 2 at a different angle.

Turning now to FIG. 15, the partition 150 is shown in isolation. Straps $\mathbf{170}_{1\text{-}4}$ are exposed, which reveals the loop 172. An inside 173 of the loop 172 may fit snugly on the container lip 112. A first edge 174 of the strap 170 and a second edge 175 of the strap 170 may be spaced apart at a desired distance.

Figure 16:
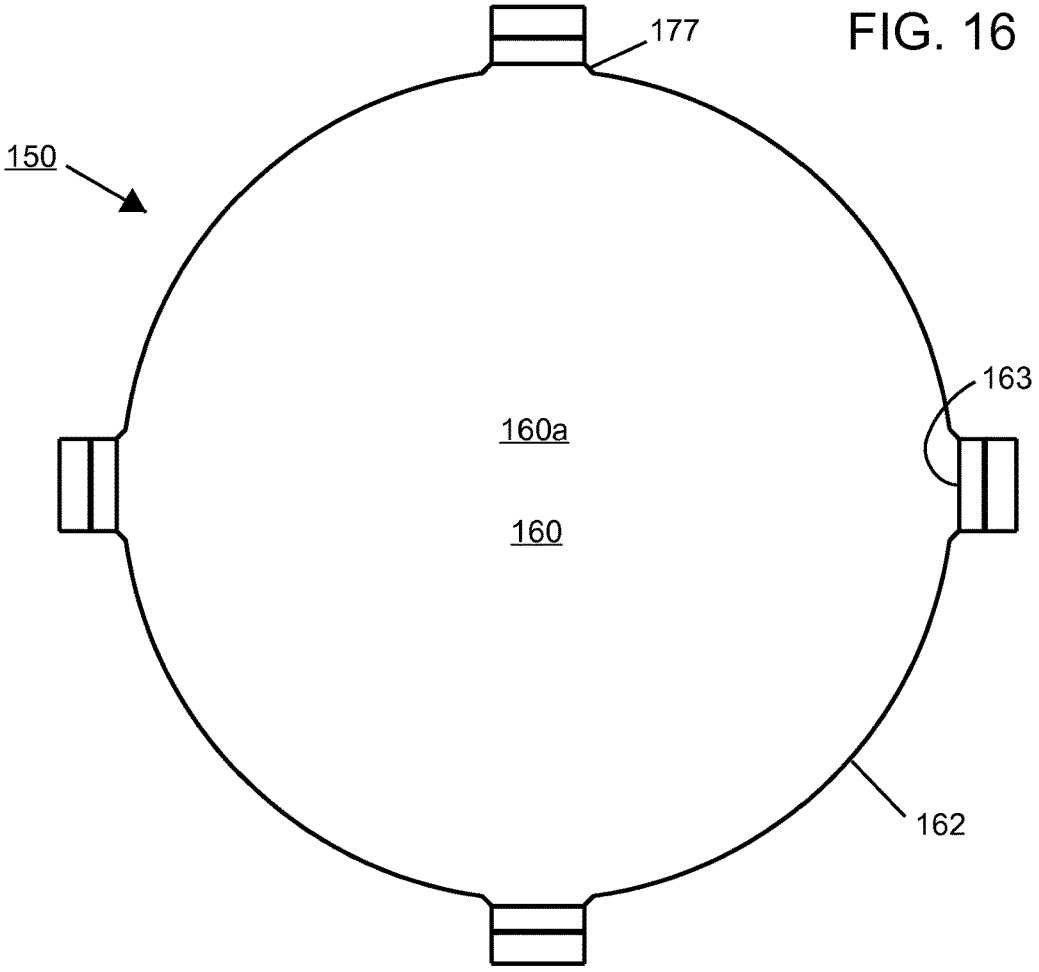
FIG. 16 is a top view of one of the single partition of FIG. 15. This view shows a protrusion near a base of the strap of FIG. 2 as a possible way to prevent ripping.

Turning now to FIG. 16, a bottom view of the partition 150 is shown. A perimeter 162 of the partition tray 160 may be set to match the perimeter of the container 104. For example, if the perimeter 104 of the container 110 is in the shape of a rectangle, the perimeter 162 of the partition tray 160 would also be in the shape of a rectangle. This allows the partition 150 to fit neatly into the container 110. This allows the partition 150 to seal to the container 110. By sealing, freezer burn, sublimation, frost formation, etc. may be prevented below the partition 150. There is a protrusion 177 (e.g., bump, knob, ridge, fillet, etc.) that allows the straps 170 to fold, thus creating a crease 163. The protrusion 177 could be added in order to prevent ripping. As the thickness 150*t* may be sufficiently thin, these features may be compressed such that the sealing function is preserved.

Figure 17:
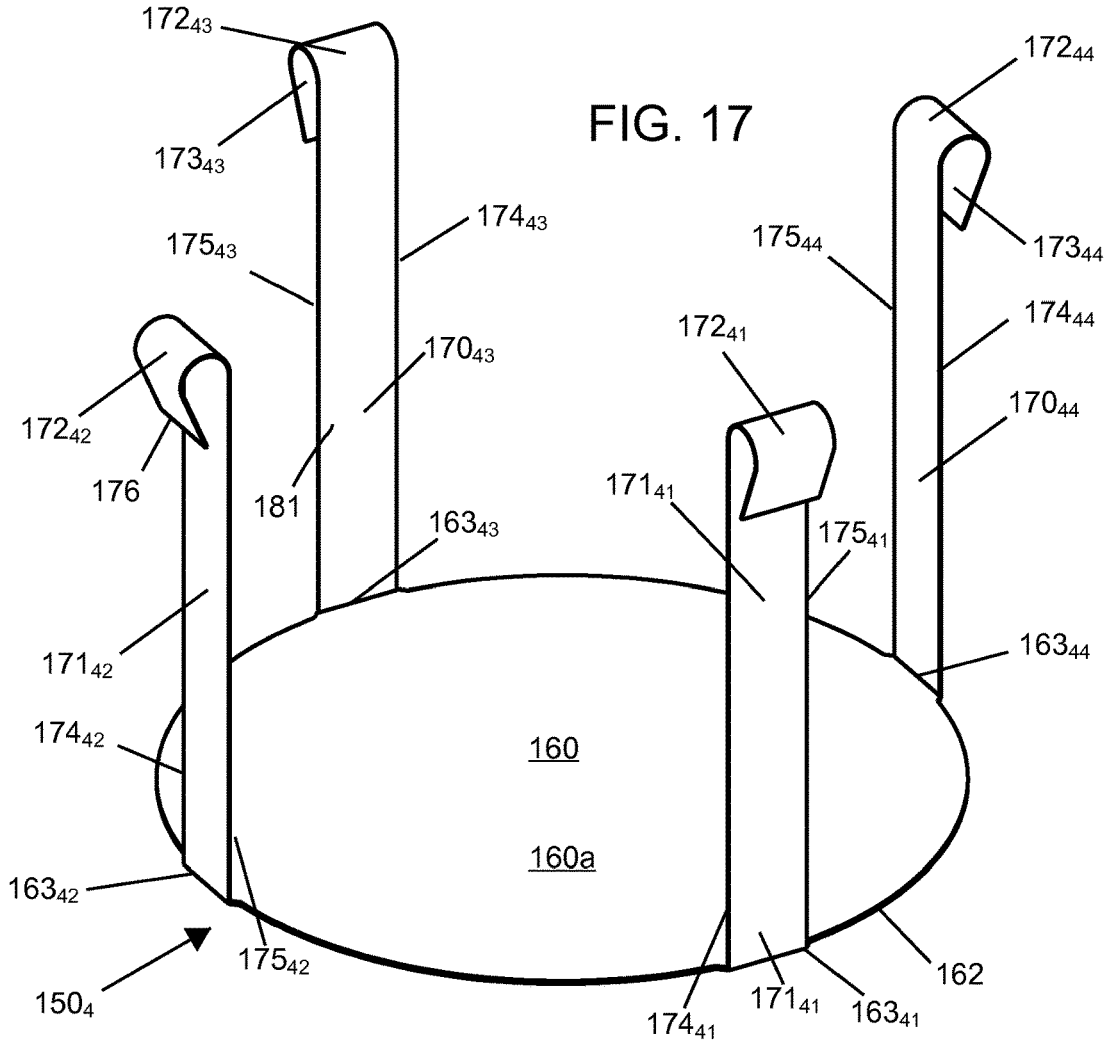
FIG. 17 is a top perspective view of one of the partitions of FIG. 2.

Turning now to FIG. 17, the partition tray 160 is shown with four of the straps 170 raised from it. The loop 172 is at a top of the strap 170. The loop 172 could curve around the lip 112, and be held in place by the lid 130. The straps 170 could also be held in place by tape or other adhesive. The straps 170 could be numbered, or otherwise marked correspondingly to their partitions 150, for easier understanding of the partitions 150 that would be lifted and/or guidance as to which order to remove the partitions 150. An inside 181 of the strap 170 may contact the perimeter 215 of the food portion 200 while an outside 171 of the strap 170 would be in contact with the perimeter 104 of the container 110. The inside 181 of the strap 170 and the outside 171 of the strap 170 are spaced apart by a thickness 150*t* of the strap 170. There may be more than one strap 170.

Figure 18:
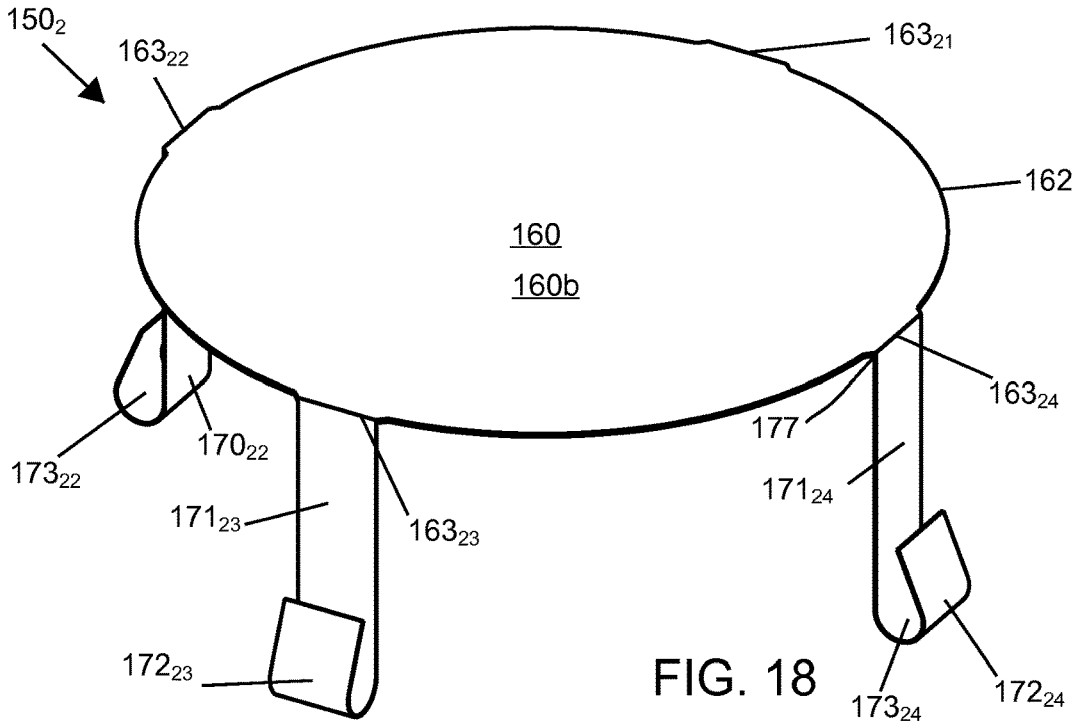
FIG. 18 is a bottom perspective view of one of the partitions of FIG. 2.

Turning now to FIG. 18, the bottom 160*b* of the partition tray 160 is shown with four straps 170 extending from it.

Turning now to FIG. 19, a cutting utensil 250 is shown cutting the food portion $\mathbf{200}_1$. Certain cutting utensils 250 are designed in certain shapes. The cutting utensil 250 in the example is a circle. Cutting the food portion 200 with differently shaped cutting utensils 250 will yield differently shaped food portions 200*p*. The cutting utensil 250 may be stopped at the partition tray 160 at FIG. 19, but could be pressed deeper into the next layer and beyond.

Turning now to FIG. 20, a perspective view illustrates a rectangular container 400. The rectangular container 400 has a rectangular lid 330 that is connected by the hinge 270 to the container. A long strap 180 may be temporarily attached to the rectangular lid 330. This can be used as a method to keep a grasping portion of the long strap 180 clean. In this embodiment, the straps 170 may be stacked directly on top of each other, rather than offset from each other (see FIG. 7). The perimeter 215 of the food portions 200 also include some rectangular food portions $\mathbf{300}_{1\text{-}6}$ and fit neatly into the container 400.

FIGS. 7 through 13 and 19 show the various ways of serving a frozen confection.

A method for creating the packaging of food may include placing the partition 150 in position, placing the food portion 200 on top of the partition 150, and repeating until a desired number of food portions 200 are stacked. The top partition $\mathbf{150}_0$ may be placed above the food portion $\mathbf{200}_1$ to prevent freezer burn and other damage (oxidation, sublimation, frost formation, etc.), or it may be omitted to save on packaging costs. The partitions 150 may be made out of wax paper, parchment, parchment with foil, or any edible or non-edible divider. A manufacturing plant may have a machine that could stamp the partitions 150 into place, put a food portion 200 on top, and repeat until desired amount of food portions 200 and partitions 150 are stacked.

Upon removing (e.g., serving) a food portion 200 (e.g., $200_2$), the exposed partition 150 (e.g., $150_2$) may be left in place to protect the remaining food portion 200 (e.g., $200_3$) from freezer burn, oxidation, sublimation, frost formation, other damage, etc.

The partitions 150 may be also used to separate different kinds of food or flavors in one package. For example, chocolate ice cream may be food partition $200_1$ while vanilla ice cream may be food partition $200_2$, then repeating the process until the desired number of different foods is reached.

The food portion 200 may be lifted vertically out as shown in FIG. 7 and placed on a serving tray. Parchment and wax paper have proven to be effective non-stick dividers for partitions 150. A reinforced paper such as Tyvek® may be used for its strength (e.g., strong enough to handle lifting the food portion 200 without ripping.)

The food slab 200 may be used with cookie cutters 250 as shown in FIG. 19 to easily cut intricate or simple shapes out of the food slab 200. For instance, a gelatin dessert may be cut out in different shapes to better entertain guests or for ease of serving. In the case of ice cream, shapes such as circle may be cut out of it in order to create ice cream sandwiches. The perimeter 104 of the container 110 may be shaped as desired, making each food portion 200 shaped in the desired shape. For example, the perimeter 104 of the container 110 may be designed in the shape of a heart, so that each food portion 200/serving size is in the shape of a heart. Having pleasing shapes for things such as ice cream or gelatin desserts may be used for entertaining guests.

The partitions 150 may add to the ease of scooping out firmer foods 200, such as frozen cookie dough and frozen ice cream. As shown in FIGS. 9 and 10, hard foods 200 can be scooped with a typical serving utensil 500. With this development, heavy-duty ice cream scoops and cookie scoops may no longer be required.

The partitions 150 divide the food portion 200, making it possible to slice the food 200 to a desired food portion 200 and served, as shown in FIGS. 12 and 13. This also negates the need for heavy-duty ice cream and cookie scoops, as well as the need for the bottom partition 150 (e.g., $150_6$). The whole food portion 200 may also be taken out and sliced up to the desired serving size.

Having the partitions 150 divide the food 200 creates a good portion control system. Instead of consuming the entire container 110 of food 200, the consumer will reach the partition, be reminded of how much food 200 has been consumed, and be more inclined to stop consuming. This solution requires less packaging material than the current solution to this problem, which is packaging food 200 into small individual containers of food. The ice cream container 110 may be shaped so each food portion 200 would be equivalent to a single serving sized food portion 200.

The shape of the partitions 150 may change to fit the shape of food container 110. For example, ice cream container 110 can come in the shapes of a rectangular prism, a cylinder, a scround etc., thus the partition 150 could be changed to some rectangular partitions $350_{1-6}$, a circle, or a scround in order to match the container 110.

Having partitions 150 between the food portions 200 could help prevent freezer burn in the case of ice cream and other frozen foods. In some cases, only the top food portion 200 would be exposed to the risk of developing freezer burn, while the other food portions 200 would be protected by at least one partition 150. In other cases, the consumer could save the partition 150 after removing it from the top 116, take as much food 200 as desired, then replace the partition 150. This action would keep all food portions 200 safe from freezer burn.

The separation of the food portions 200 by the partitions 150 provide various methods to remove the food portions 200 from the container 110. The consumer may use a serving utensil 500 to remove all of a given food portion 200; may pull out a complete food portion 200 via the straps 170 or handles 155; may cut away and remove a portion 200*p* of the food portion 200 from the remaining food portion 200*r* with a cutting utensil 252 (e.g. knife, chopper, etc.); and/or use a cookie cutter 250 to remove a portion 254 of the food portion 200 (see FIGS. 9 and 19). These methods may be combined in various combinations. For example, several portions 200*p* may be taken out with the serving utensil 500, and the remaining portion 200*r* may be taken out by the straps 170.

The food portion 200 can be removed easily by pulling on the straps 170, pulling on the handles 155, or by performing some other similar action. The perimeter 215 of the food portion 200 may slide against the perimeter 104 of the container 110; however, the whole of the food package 100 may remain intact. In certain embodiments, none of the food package 100 needs to be ripped or otherwise dismantled in order to obtain the food portion 200.

The straps 170 of the partition 150 may be attached to the partition tray 160 as one continuous piece (e.g., a single sheet of material). The whole partition 150 may be cut out as one part with no separate pieces. Alternatively, the straps 170 may weave under the partition tray 160, thus creating a partition 150 with more than one part.

The handles 155 do not need to be in contact with the food portion 200 and therefore may stay neat and clean. The handles 155 may be positioned on top of partition $150_0$.

Freezer burn, oxidation, sublimation, layer of frost, etc. is not necessarily protected by the lid 130 (e.g., a lid of a conventional ice cream container). Freezer burn is caused if the air comes into contact with the food portion 200. The lid 130 protects against freezer burn only if there is no removed food portion 200*p*. Having sealed partitions 150 would protect the separate food portions 200.

Ice cream is defined as a frozen milk product that has been whipped. The many different types of ice cream are economy ice cream, which contains exactly 10% butterfat; regular ice cream, which contains 10% to 11% butterfat; premium ice cream, which has 11%-15% butterfat; super premium ice cream, which has 11%-15% butterfat and has no high fructose corn syrup; lite ice cream, which has either 33% fewer calories or 50% less fat than the original product; reduced fat ice cream, which has 25% less fat than the original product; and soft serve ice cream, which is served at warmer temperatures.

Other frozen confections may include the following: french style ice cream (e.g., glace), which has a custard base with egg yolks; gelato, which is only made up of 20% air (regular ice cream is made up of 60% air); sorbet, which is made up of fruit purée instead of milk, and is whipped; sherbet, which is fruit based and contains milk, but contains less than 2% butterfat; and granita, which is similar to sorbet, but it is not whipped and may contain ice crystals.

Experiments were done on super premium ice cream (Trader Joe's French Vanilla Ice Cream Super Premium, identified by number 0045 8832) in a half gallon scround shaped container at 10 degrees Fahrenheit. An unmodified ice cream package was used as a control. An experimental package was prepared by slicing the ice cream into approximately one inch thick slabs. The slabs were separated by wax paper, parchment paper, and one-side parchment/one-side foil material and repositioned in the package. Both packages were returned to the freezer. The force required to serve the layered ice cream required about 7 pounds of force to scoop, and the unmodified ice cream required about 12 pounds of force to scoop, using the same serving utensil.

Certain ice cream containers 110 include a tapered shape (i.e., the perimeter 104 of the container 110 is reduced in cross-section nearer a bottom 108 of the interior 114). To accommodate such non-constant cross-sections, the partition tray 160 may be bent up at the edge 162 (i.e., the perimeter 162). Alternatively, different sized partition trays 160 may be used to locally match the perimeter 104. A seal may be formed between the perimeter 104 and the perimeter 162 in each case. A seal may be maintained between the perimeter 104 and the perimeter 162 even where straps 170 run between the perimeter 104 and the perimeter 162.

The reduction in scooping force is thought to occur because the separating layer introduces structural weakness in the ice cream. The shear loads introduced by the serving scoop 504 is thought to connect with this structural weakness and result in easier breaking out of the ice cream.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A container of food comprising:

an enclosure including an interior with a base portion and a perimeter portion, the perimeter portion of the interior extending between the base portion of the interior and an opening of the enclosure;

a lid adapted to cover the opening of the enclosure when the container is in a storage configuration and also adapted to uncover the opening of the enclosure when the container is in a serving configuration; and a partition member separating a first food layer from a second food layer, the partition member including a separating portion with a perimeter substantially matching a cross-sectional shape of the perimeter portion of the interior of the enclosure, and the partition member further including at least one pulling structure extending from the separating portion to a grip of the pulling structure positioned outside of the interior of the enclosure at least when the container is in the storage configuration;

wherein the lid includes a lip, wherein the perimeter portion of the interior terminates at an edge that surrounds the opening of the enclosure, and wherein the lip of the lid surrounds the edge of the perimeter portion when the container is in the storage configuration;

wherein the at least one pulling structure is hooked over the edge at least when the container is in the storage configuration; and wherein the grip of the pulling structure is positioned between an interior surface of the lip of the lid and an exterior of the enclosure.

2. The container of food of claim 1, wherein the partition member includes two pairs of the pulling structures, wherein a first pair of the two pairs of the pulling structures are joined together and thereby form a first handle, and wherein a second pair of the two pairs of the pulling structures are joined together and thereby form a second handle.

3. The container of food of claim 1, wherein the separating portion and the at least one pulling structure are formed from a single sheet of material.

4. The container of food of claim 1, wherein the perimeter of the separating portion substantially seals with the perimeter portion of the interior of the enclosure.

5. The container of food of claim 1, wherein the perimeter of the separating portion forms a seal with the perimeter portion of the interior of the enclosure.

6. The container of food of claim 5, wherein the seal is adapted to protect the second food layer from freezer burn.

7. The container of food of claim 5, wherein the seal is adapted to protect the second food layer from freezer burn after the first food layer has been removed from the interior of the enclosure.

8. The container of food of claim 1, wherein the partition member is a first partition member, the container further comprising a second partition member separating the second food layer from a third food layer, the second partition member including a separating portion with a perimeter substantially matching the cross-sectional shape of the perimeter portion of the interior of the enclosure, the second partition member further including at least one pulling structure extending from the separating portion of the second partition member to a grip of the second partition member positioned outside of the interior of the enclosure, and the at least one pulling structure of the second partition member extending through an interface between the perimeter of the separating portion of the first partition member and the perimeter portion of the interior of the enclosure.

9. The container of food of claim 8, further comprising a third partition member separating the third food layer from a fourth food layer, the third partition member including a separating portion with a perimeter substantially matching the cross-sectional shape of the perimeter portion of the interior of the enclosure, the third partition member further including at least one pulling structure extending from the separating portion of the third partition member to a grip of the third partition member positioned outside of the interior of the enclosure, and the at least one pulling structure of the third partition member extending through an interface between the perimeter of the separating portion of the first partition member and the perimeter portion of the interior of the enclosure and also extending through an interface between the perimeter of the separating portion of the second partition member and the perimeter portion of the interior of the enclosure.

10. The container of food of claim 1, wherein the partition member is one of a plurality of partition members including at least one pulling structure, wherein the first food layer and the second food layer are two of a plurality of food layers, wherein the plurality of partition members separate the plurality of food layers, respectively, and wherein each of the at least one pulling structure of the plurality of partition members extends to a grip positioned outside of the interior of the enclosure.

11. The container of food of claim 10, wherein each of the at least one pulling structure of the plurality of partition members is positioned along a different path and thereby do not overlap each other.

12. The container of food of claim 11, wherein the different paths are rotationally spaced from each other about an axis of the enclosure.

13. The container of food of claim 10, wherein each of the at least one pulling structure of the plurality of partition members extends a different length.

14. The container of food of claim 13, wherein each of the grips of the at least one pulling structure of the plurality of partition members is spaced from the opening of the enclosure substantially the same.

15. The container of food of claim 1, further comprising a base partition member separating the second food layer from the base portion of the interior, the base partition member including a separating portion with a perimeter substantially matching the cross-sectional shape of the perimeter portion of the interior of the enclosure, the base partition member further including at least one pulling structure extending from the separating portion of the base partition member to a grip of the base partition member positioned outside of the interior of the enclosure, and the at least one pulling structure of the base partition member extending through an interface between the perimeter of the separating portion of the partition member and the perimeter portion of the interior of the enclosure.

16. The container of food of claim 1, further comprising an opening partition member separating the lid from the first food layer when the container is in the storage configuration, the opening partition member including a separating portion with a perimeter substantially matching the cross-sectional shape of the perimeter portion of the interior of the enclosure, the opening partition member further including at least one pulling structure extending from the separating portion of the opening partition member to a grip of the opening partition member positioned outside of the interior of the enclosure, and the at least one pulling structure of the partition member extending through an interface between the perimeter of the separating portion of the opening partition member and the perimeter portion of the interior of the enclosure.

17. The container of food of claim 1, wherein the perimeter portion is a revolved shape.

18. The container of food of claim 17, wherein the revolved shape is cylindrical.

19. The container of food of claim 1, wherein the opening of the enclosure is positioned opposite the base portion of the interior of the enclosure.

20. The container of food of claim 1, wherein the lid is completely removed from the enclosure when the container is in the serving configuration.

21. The container of food of claim 1, wherein the lid is attached to the enclosure when the container is in the storage configuration.

22. The container of food of claim 21, wherein the lid remains attached to the enclosure when the container is in the serving configuration.

23. The container of food of claim 1, wherein the edge of the perimeter portion of the interior of the enclosure is a rolled edge.

24. The container of food of claim 23, wherein the rolled edge rolls outwardly away from the interior of the enclosure.

25. The container of food of claim 24, wherein a pocket is formed by an interior surface of the lip of the lid, the rolled edge, and an exterior of the enclosure when the container is in the storage configuration.

26. The container of food of claim 25, wherein the grip of the pulling structure is positioned within the pocket when the container is in the storage configuration.

27. The container of food of claim 25, wherein the grip is positioned on a handle of the pulling structure and wherein the handle is positioned within the pocket when the container is in the storage configuration.

28. The container of food of claim 27, wherein the handle is formed by a pair of the pulling structures.

29. The container of food of claim 1, wherein the partition member includes at least a pair of the pulling structures.

30. The container of food of claim 29, wherein the pair of the pulling structures are positioned opposite each other.

31. The container of food of claim 29, wherein the pair of the pulling structures are joined together and thereby form a handle.

32. The container of food of claim 1, wherein the partition member includes a plurality of the pulling structures.

33. The container of food of claim 1, wherein the at least one pulling structure is positioned adjacent the perimeter portion of the interior.

34. The container of food of claim 1, wherein the at least one pulling structure is positioned adjoining the perimeter portion of the interior.

35. A method for packaging food comprising:

providing a container including an enclosure including an interior with a base portion and a perimeter portion, the perimeter portion of the interior extending between the base portion of the interior and an opening of the enclosure;

placing a first food layer including a first side and an opposite second side in the container, a perimeter portion of the first food layer extending between the first side and the second side of the first food layer and substantially matching a corresponding portion of the perimeter portion of the interior;

placing a partition member in the container, the partition member including a separating portion with a perimeter substantially matching a cross-sectional shape of the perimeter portion of the interior of the enclosure, and the partition member including at least a pair of pulling structures, the separating portion positioned adjacent the second side of the first food layer, and the pulling structures extending from the separating portion through the opening of the enclosure and to a grip positioned outside of the interior of the enclosure;

placing a second food layer including a first side and an opposite second side in the container, a perimeter portion of the second food layer extending between the first side and the second side of the second food layer and substantially matching a corresponding portion of the perimeter portion of the interior, the first side of the second food layer positioned adjacent the separating portion;

placing a lid of the container over the opening of the enclosure and thereby covering the opening of the enclosure and thereby configuring the container in a storage configuration, wherein the lid includes a lip, wherein the perimeter portion of the interior terminates at an edge that surrounds the opening of the enclosure, and wherein the lip of the lid surrounds the edge of the perimeter portion when the container is in the storage configuration;

hooking the pulling structure over the edge at least when the container is in the storage configuration; and positioning the grip of the pulling structures between an interior surface of the lip of the lid and an exterior of the enclosure;

wherein the lid of the container is adapted to uncover the opening of the enclosure when the container is in a serving configuration; and wherein the first food layer is separated from the second food layer by the partition member.

36. The method of claim 35, further comprising opening the lid of the container and thereby configuring the container in the serving configuration.

37. The method of claim 36, wherein the opening of the lid of the container exposes the second food layer.

38. The method of claim 36, further comprising serving the second food layer.

39. The method of claim 36, further comprising removing the partition member by pulling on the grip after substantially all of the second food layer has been served and thereby exposing the first food layer.

40. The method of claim 36, further comprising removing at least a portion of the second food layer by pulling on the grip of the partition member and thereby removing the partition member from the container.

41. A container for food comprising:

an enclosure including an interior with a base portion and a perimeter portion, the perimeter portion of the interior extending between the base portion of the interior and an opening of the enclosure;

a lid adapted to cover the opening of the enclosure when the container is in a storage configuration and also adapted to uncover the opening of the enclosure when the container is in a serving configuration;

a first lifting member adapted to lift a first food layer from a second food layer, the first lifting member including a first lifting portion adapted to be positioned between the first food layer and the second food layer, and the first lifting member further including at least one pulling structure extending from the first lifting portion to a grip of the first lifting member positioned outside of the interior of the enclosure at least when the container is in the storage configuration, the at least one pulling structure of the first lifting member positioned adjacent the perimeter portion of the interior; and a second lifting member adapted to lift the second food layer from a third food layer, the second lifting member including a second lifting portion adapted to be positioned between the second food layer and the third food layer, the second lifting member further including at least one pulling structure extending from the second lifting portion of the second lifting member to a grip of the second lifting member positioned outside of the interior of the enclosure at least when the container is in the storage configuration, the at least one pulling structure of the second lifting member positioned adjacent the perimeter portion of the interior.

42. The container for food of claim 41, wherein the lid includes a lip, wherein the perimeter portion of the interior terminates at an edge that surrounds the opening of the enclosure, and wherein the lip of the lid surrounds the edge of the perimeter portion when the container is in the storage configuration.

43. The container for food of claim 42, wherein at least one of the grips of the pulling structures is positioned between an interior surface of the lip of the lid and an exterior of the enclosure.

44. The container for food of claim 41, wherein the at least one pulling structure of the second lifting member is adapted to extend through an interface between the first food layer and the perimeter portion of the interior and also is adapted to extend through an interface between the second food layer and the perimeter portion of the interior.

45. The container for food of claim 41, wherein the at least one pulling structure of the first lifting member is adapted to extend through an interface between the first food layer and the perimeter portion of the interior.

* * * * *